US012390684B2

(12) United States Patent
Aoki et al.

(10) Patent No.: US 12,390,684 B2
(45) Date of Patent: Aug. 19, 2025

(54) LOWER LIMB EXERCISE DEVICE AND LOWER LIMB EXERCISE SYSTEM

(71) Applicant: TOYOTA JIDOSHA KABUSHIKI KAISHA, Toyota (JP)

(72) Inventors: Eisuke Aoki, Toyota (JP); Tomio Ikeda, Toyota (JP); Tadashi Odashima, Seto (JP); Takahiro Takeda, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 109 days.

(21) Appl. No.: 18/378,198

(22) Filed: Oct. 10, 2023

(65) Prior Publication Data

US 2024/0139583 A1 May 2, 2024

(30) Foreign Application Priority Data

Nov. 1, 2022 (JP) ..... 2022-175359

(51) Int. Cl.
*A63B 22/06* (2006.01)

(52) U.S. Cl.
CPC .. *A63B 22/0694* (2013.01); *A63B 2208/0233* (2013.01); *A63B 2225/09* (2013.01)

(58) Field of Classification Search
CPC ..... A63B 22/0694; A63B 2208/0233; A63B 2225/09; A63B 21/1609; A63B 21/4034; A63B 22/0605
See application file for complete search history.

(56) References Cited

U.S. PATENT DOCUMENTS 2,735,422 A * 2/1956 Jones ..... A63B 22/0694 601/36
4,390,177 A * 6/1983 Biran ..... A63B 22/0605 188/83
5,314,392 A * 5/1994 Hawkins ..... A63B 22/0056 482/52
5,647,822 A * 7/1997 Avganim ..... A63B 22/0007 482/57
7,621,852 B2 * 11/2009 Bowser ..... A63B 23/12 482/121
8,795,141 B2 * 8/2014 Huang ..... A63B 22/0605 482/142
10,220,246 B2 * 3/2019 Lernihan ..... A63B 22/0664
D906,445 S * 12/2020 Colburn ..... A63B 21/00069 D21/663
11,305,153 B2 * 4/2022 Dalmia ..... A63B 22/06
(Continued)

FOREIGN PATENT DOCUMENTS

JP 2000-116818 A 4/2000
JP 2022-163744 A 10/2022

*Primary Examiner* — Andrew S Lo
(74) *Attorney, Agent, or Firm* — Dinsmore & Shohl LLP

(57) ABSTRACT

A lower limb exercise device that enables a user to perform a lower limb exercise effectively is achieved. A lower limb exercise device according to one embodiment of the present disclosure enables a user to perform a lower limb exercise while the user is seated on a chair. The lower limb exercise device includes exercise equipment for the user to perform the lower limb exercise, and a restriction mechanism configured to restrict movement of at least one caster of the chair from a reference arrangement range of the caster during the lower limb exercise.

10 Claims, 22 Drawing Sheets

(56) References Cited

U.S. PATENT DOCUMENTS

| | | | | |
|---|---|---|---|---|
| 2014/0274622 | A1* | 9/2014 | Leonhard | A47C 9/002 403/345 |
| 2016/0107026 | A1* | 4/2016 | Hsu | A63B 22/0058 482/80 |
| 2017/0216660 | A1* | 8/2017 | Lernihan | A63B 22/0694 |
| 2018/0339190 | A1* | 11/2018 | Bailar | A63B 22/0046 |
| 2020/0289882 | A1* | 9/2020 | Pena | A63B 21/1609 |
| 2020/0298052 | A1* | 9/2020 | Dalmia | A63B 22/0694 |
| 2022/0331652 | A1 | 10/2022 | Aoki et al. | |

* cited by examiner

LOWER LIMB EXERCISE DEVICE AND LOWER LIMB EXERCISE SYSTEM

CROSS REFERENCE TO RELATED APPLICATIONS

This application is based upon and claims the benefit of priority from Japanese patent application No. 2022-175359, filed on Nov. 1, 2022, the disclosure of which is incorporated herein in its entirety by reference.

BACKGROUND

The present disclosure relates to a lower limb exercise device and a lower limb exercise system.

For example, Japanese Unexamined Patent Application Publication No. 2000-116818 discloses a lower limb exercise device based on pedaling exercises. The lower limb exercise device of Japanese Unexamined Patent Application Publication No. 2000-116818 includes a seat surface, a pair of left and right pedals, a crank, and a load apparatus. A trainee (user) sits on the seat surface and rotates the pair of left and right pedals. The seat surface is fixed to a frame.

SUMMARY

The applicant has found the following problem. In such a lower limb exercise device, the user usually performs a lower limb exercise while sitting on a chair. At this time, a problem occurs in that a relative position of the chair to the lower limb exercise device is shifted due to a reaction force of the foot pedaling. Therefore, the user may not be able to perform a pedaling exercise effectively.

The present disclosure has been made in view of the above problem, and achieves a lower limb exercise device and a lower limb exercise system that enable a user to perform a lower limb exercise effectively.

A lower limb exercise device according to one aspect of the present disclosure for enabling a user to perform a lower limb exercise while the user is seated on a chair includes:

exercise equipment for the user to perform the lower limb exercise; and a restriction mechanism configured to restrict movement of at least one caster of the chair from a reference arrangement range of the caster during the lower limb exercise.

In some embodiments of the above lower limb exercise device, an upper part of the restriction mechanism is open.

In some embodiments of the above lower limb exercise device, the restriction mechanism is capable of adjusting a position of the reference arrangement range of the caster in a front-rear direction.

In some embodiments of the above lower limb exercise device, the position of the reference arrangement range of the caster is made adjustable in the front-rear direction by providing a plurality of the restriction mechanisms in the front-rear direction of the lower limb exercise device.

In some embodiments of the above lower limb exercise device, the position of the reference arrangement range of the caster is made adjustable in the front-rear direction by moving the restriction mechanism in the front-rear direction of the lower limb exercise device.

In some embodiments of the above lower limb exercise device, the restriction mechanism includes a contact part where the caster that moves away from the exercise equipment is brought into contact, a position of the contact part relative to the exercise device is constrained in a region on a side moving away from the exercise equipment in the front-rear direction of the lower limb exercise equipment, and an upper end of the contact part is arranged higher than a center of the caster with the caster arranged inside the reference arrangement range and the contact part arranged at an uppermost position.

In some embodiments of the above lower limb exercise device, the contact part is a movable plate that can move in an up-down direction of the lower limb exercise device and is energized upward of the lower limb exercise device.

In some embodiments of the above lower limb exercise device, the contact part is a rotating member that is rotatable around a rotation axis extending in an up-down direction or a left-right direction of the lower limb exercise device and whose rotation is restricted so as to restrict movement of the caster to a side moving away from the exercise equipment when the caster moving away from the exercise equipment is brought into contact.

In some embodiments of the above lower limb exercise device, a plurality of the contact parts are arranged in the front-rear direction of the lower limb exercise device.

In some embodiments of the above lower limb exercise device, the restriction mechanism includes a grounding part of the caster, a position of the grounding part relative to the exercise equipment is constrained in a region on a side moving away from the exercise equipment in the front-rear direction of the lower limb exercise device, and a frictional force on the side moving away from the exercise equipment is greater than a frictional force on the side of the exercise equipment.

In some embodiments of the above lower limb exercise device, the grounding part includes a projection that is inclined upward of the lower limb exercise device toward the exercise equipment, and the projection is made of an elastic body and a plurality of the projections are arranged in the front-rear direction of the lower limb exercise device.

In some embodiments of the above lower limb exercise device, the restriction mechanism is a constraint mechanism that constrains a position of the caster or the chair relative to the exercise equipment so as to maintain the caster arranged inside the reference arrangement range.

In some embodiments of the above lower limb exercise device, the restriction mechanism is detachable from the exercise equipment.

A lower limb exercise system according to one aspect of the present disclosure includes:

the above lower limb exercise device; and the chair.

In some embodiments of the above lower limb exercise system, the exercise equipment includes:

a pair of left and right pedals on which the user's feet are placed; and a rotation mechanism configured to rotate the pedals by the user's feet pushing down the pedals.

According to the present disclosure, a user can perform a lower limb exercise effectively.

The above and other objects, features and advantages of the present disclosure will become more fully understood from the detailed description given hereinbelow and the accompanying drawings which are given by way of illustration only, and thus are not to be considered as limiting the present disclosure.

DESCRIPTION OF EMBODIMENTS

Specific embodiments to which the present disclosure is applied are described in detail below with reference to the drawings. However, the present disclosure is not limited to the following embodiments. In addition, in order to clarify the descriptions, the following descriptions and drawings have been simplified as appropriate.

First Embodiment

Figure 1:
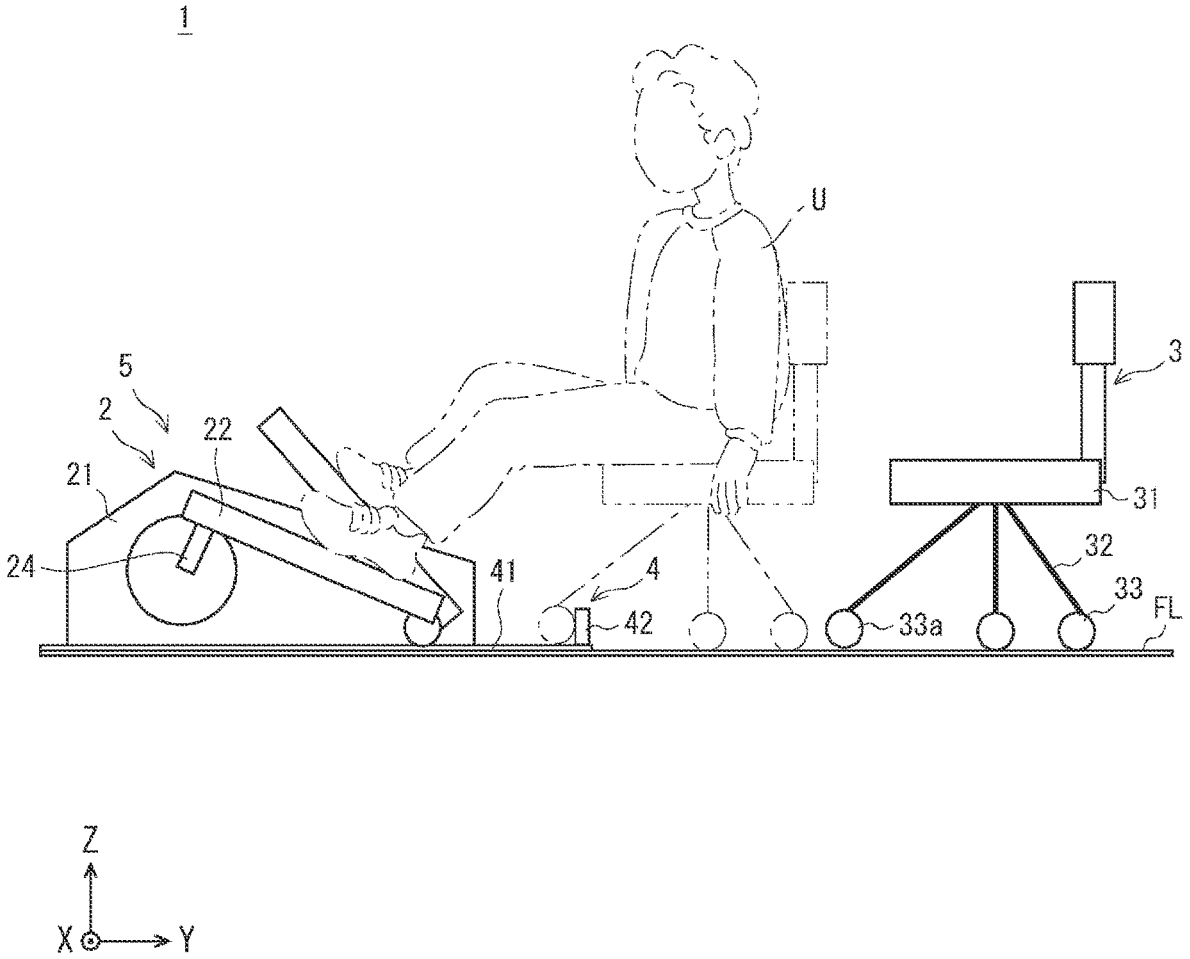
FIG. 1 is a side view showing a user performing a lower limb exercise using a lower limb exercise system according to a first embodiment.
Figure 2:
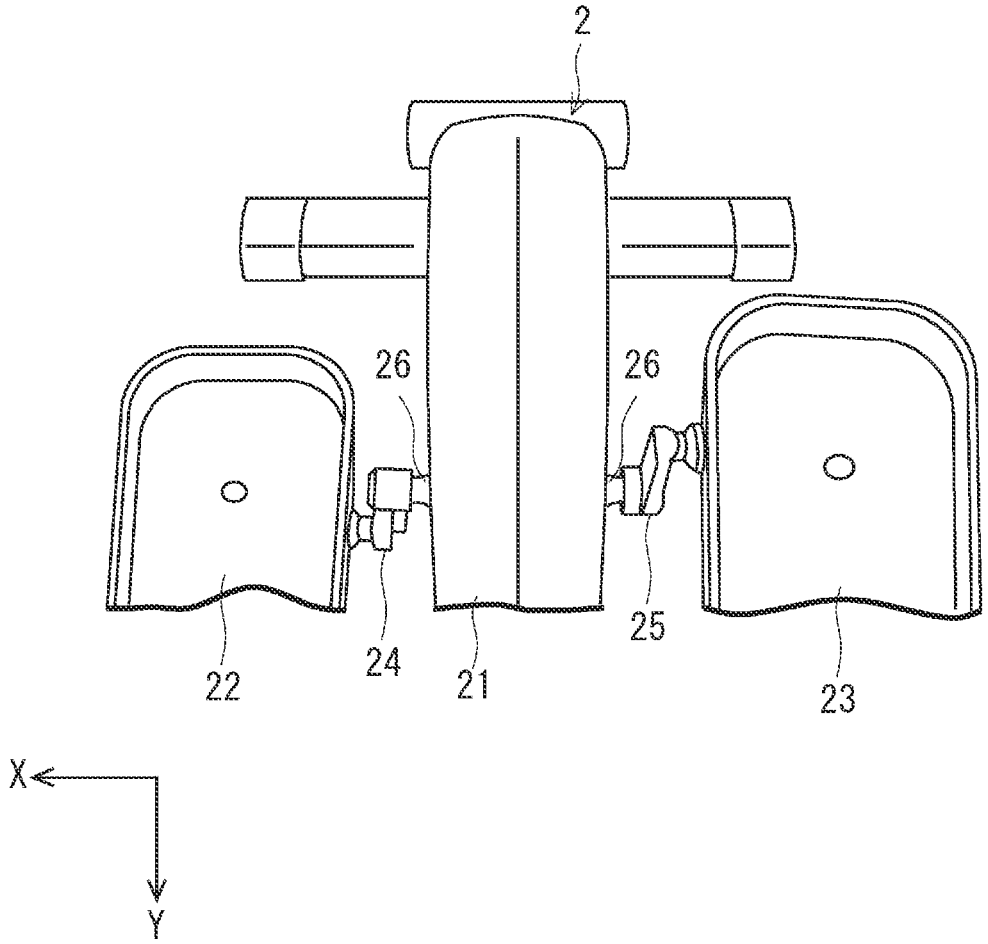
FIG. 2 is a plan view showing exercise equipment of the lower limb exercise system according to the first embodiment.

A basic configuration of a lower limb exercise system according to this embodiment is described. FIG. 1 is a side view showing a user performing a lower limb exercise using the lower limb exercise system according to this embodiment. FIG. 2 is a plan view showing exercise equipment of the lower limb exercise system according to the first embodiment. FIG. 1 simply shows a contact part of a restriction mechanism.

In the following description, a three-dimensional (XYZ) coordinate system is used for clarification. Here, an X-axis positive side is the left side of the lower limb exercise system, an X-axis negative side is the right side of the lower limb exercise system, a Y-axis positive side is the rear side of the lower limb exercise system, a Y-axis positive side is the front side of the lower limb exercise system, a Z-axis positive side is the upper side of the lower limb exercise system, and a Z-axis negative side is the lower side of the lower limb exercise system.

The lower limb exercise system 1, as shown in FIG. 1, is suitable for performing lower limb exercises using exercise equipment 2 with a user U seated on a chair 3. The lower limb exercise system 1 is arranged and used on a floor surface FL of a facility. The lower limb exercise system 1 includes the exercise equipment 2, the chair 3, and a restriction mechanism 4. The exercise equipment 2 is composed of, for example, a pedaling exercise apparatus as shown in FIG. 2, and includes a body part 21, a first pedal 22 on the X-axis positive side, and a second pedal 23 on the X-axis negative side.

When the user U's foot pushes down the first pedal 22 or the second pedal 23, the body part 21 serves as a rotation mechanism for rotating the first pedal 22 and the second pedal 23 in a circular or elliptical trajectory. Specifically, as shown in FIG. 2, one end of a first crank 24 on the X-axis positive side and one end of a second crank 25 on the X-axis negative side are coupled to the body part 21.

The first crank 24 and the second crank 25 are rotatably attached to the body part 21, as shown in FIG. 2. For example, the one end of the first crank 24 and the one end of the second crank 25 are coupled to a rotation axis 26 of the body part 21. The first crank 24 and the second crank 25 rotate around the rotation axis 26. The body part 21 may have a load resistor that imparts a load to the rotational motion of the first crank 24 and the second crank 25. The body part 21 may have a gear or the like for making the load variable.

The first pedal 22 is attached to the other end of the first crank 24. The second pedal 23 is attached to the other end of the second crank 25. The user U places his/her left foot on the first pedal 22 and his/her right foot on the second pedal 23. When the user U performs a pedaling exercise by moving his/her knee joint or hip joint by pushing down with his/her feet, the first crank 24 and the second crank 25 rotate around the rotation axis 26.

Furthermore, an angle between the first pedal 22 and the first crank 24 and an angle between the second pedal 23 and the second crank 25 changes according to the rotation of the first crank 24 and the second crank 25. The first crank 24 and the second crank 25 rotate according to the pedaling exercise of the user U so that the first pedal 22 and the second pedal 23 follow an elliptical or circular trajectory. In some embodiments, such exercise equipment 2 is portable.

The chair 3 is used by the user U to sit on, for example, at work or at home. As shown in FIG. 1, the chair 3 has a configuration in which casters 33 are fixed to leading edges of legs 32 projecting from the seat surface 31 on which the user U sits to the Z-axis negative side. In some embodiments, the casters 33 are, for example, universal casters. The chair 3 is not limited to a chair of the general form described above, and may be, for example, a wheelchair.

Figure 3:
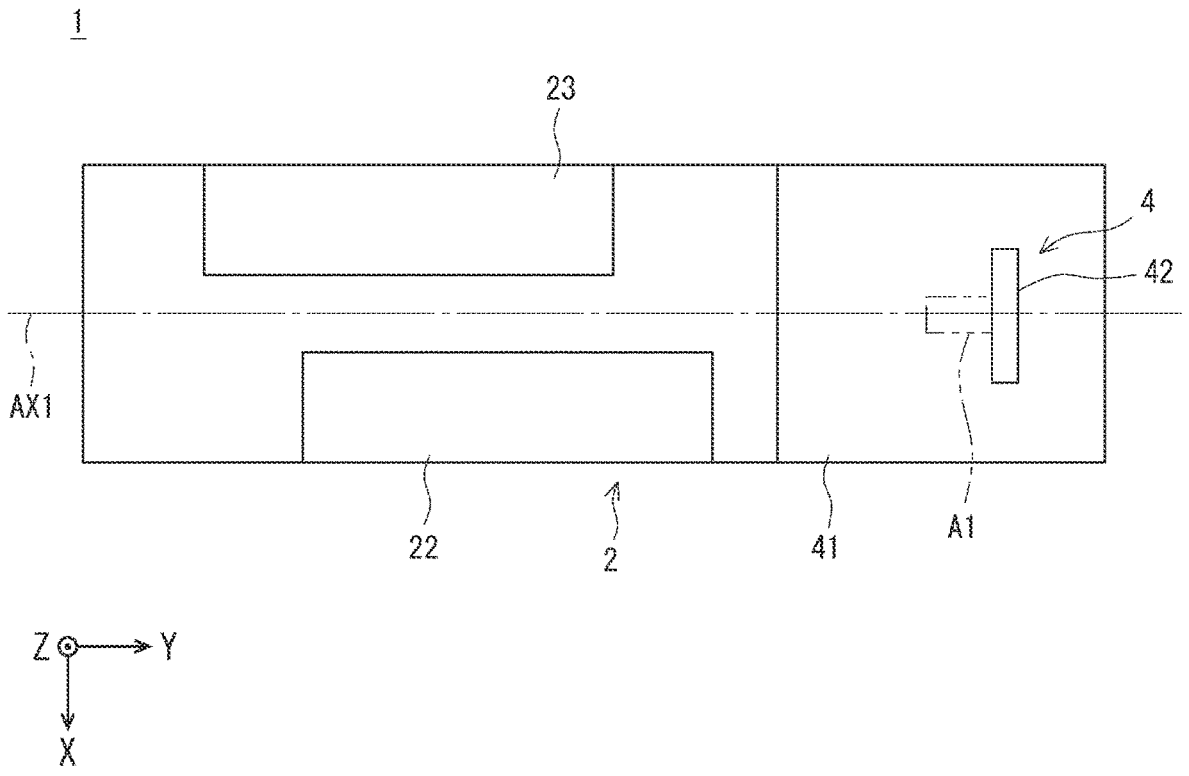
FIG. 3 is a plan view for describing an arrangement relationship between first and second pedals of the exercise equipment and a contact part of a restriction mechanism in the lower limb exercise system according to the first embodiment.

The restriction mechanism 4 includes the exercise equipment 2 and the restriction mechanism 4 to constitute a lower limb exercise device 5. The restriction mechanism 4 restricts movement of at least one caster 33 of the chair 3 from a reference arrangement range A1 (see FIG. 3) of the casters 33 during a lower limb exercise. Here, FIG. 3 is a plan view for describing an arrangement relationship between the first and second pedals of the exercise equipment and the contact part of the restriction mechanism in the lower limb exercise system according to this embodiment. In FIG. 3, the contact part of the restriction mechanism is shown briefly.

The restriction mechanism 4 has a base part 41 and a contact part 42 as shown in FIGS. 1 and 3. The base part 41 is a plate member approximately parallel to the XY plane and extends in, for example, the Y-axis direction. The exercise equipment 2 is fixed to a part of the base part 41 on the Y-axis negative side. At this time, when viewed from the Z-axis direction, a part of the base part 41 on the Y-axis positive side includes the preset reference arrangement range A1 of the casters 33 of the chair 3.

As shown in FIG. 1, when the chair 3 is about to be moved to the Y-axis positive side and the caster 33 on the Y-axis negative side of the chair 3 (hereafter, the caster on the Y-axis negative side of the chair 3 may be given a symbol 33*a* to distinguish it from other casters) is moved from the reference arrangement range A1 to the Y-axis positive side, the caster 33*a* is brought into contact with the contact part 42. As shown in FIGS. 1 and 3, the contact part 42 is arranged near the end of the reference arrangement range A1 of the caster 33*a* on the Y-axis positive side.

At this time, as shown in FIG. 3, the contact part 42 is arranged to pass through the center between the first pedal 22 and the second pedal 23 of the exercise equipment 2 and to cross, in the X-axis direction, a central axis AX1, which extends in the Y-axis direction. Therefore, the reference arrangement range A1 of the caster 33*a* is set to cross the central axis AX1 of the exercise equipment 2.

Figure 4:
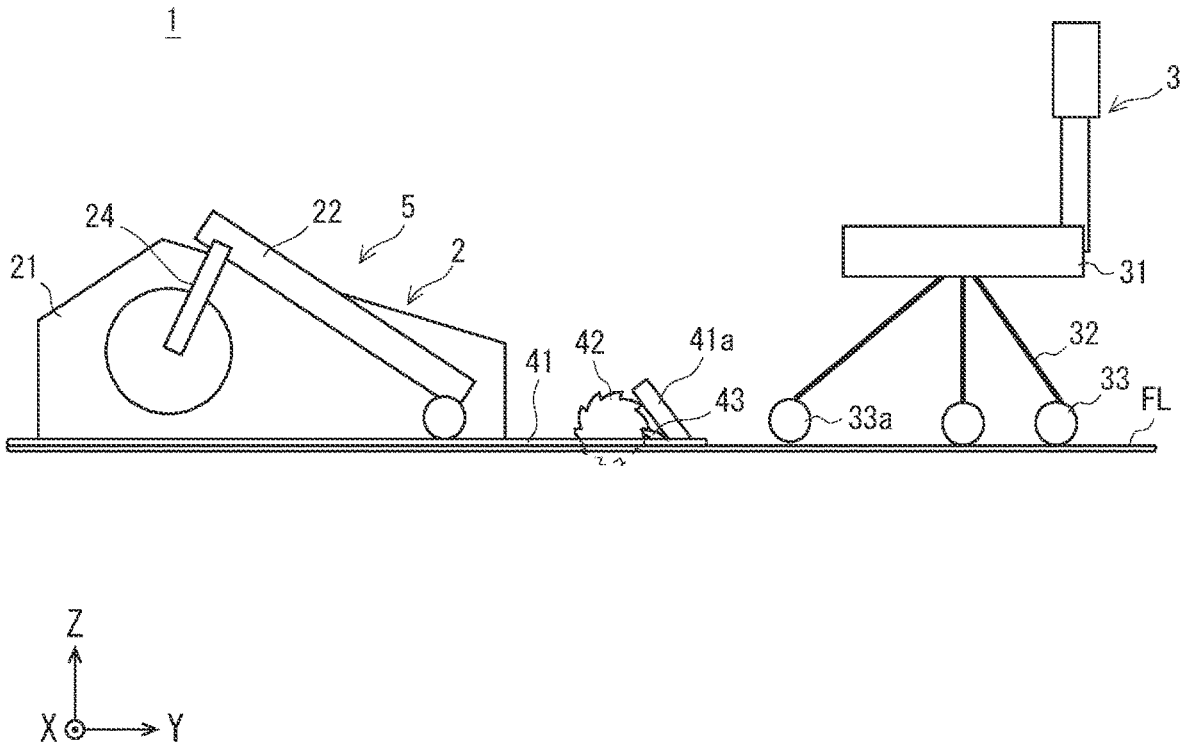
FIG. 4 is a side view showing a specific configuration of the contact part of the restriction mechanism in the lower limb exercise system according to the first embodiment.

FIG. 4 is a side view showing a specific configuration of the contact part and the like of the restriction mechanism in the lower limb exercise system according to this embodiment. The contact part 42 is, for example, a rotating member composed of a gear as shown in FIG. 4. The contact part 42 is supported by the base part 41 rotatable around a rotation axis extending in the X-axis direction.

That is, the position of the contact part 42 in the Y-axis direction of the exercise equipment 2 is constrained in a region on the Y-axis positive side of the exercise equipment 2. A width dimension of the contact part 42 in the X-axis direction is larger than a width dimension of the caster 33.

Such a contact part 42 and a claw part 43 constitute a ratchet mechanism in which counterclockwise rotation of the contact part 42 is allowed and clockwise rotation of the contact part 42 is restricted when viewed from the X-axis positive side. The claw part 43 is supported by the base part 41 rotatable around the rotation axis extending in the X-axis direction and is energized toward the contact part 42 by an elastic body.

In some embodiments, an inclined part 41*a* covering the contact part 42 from the Y-axis positive side is formed at a part of the base part 41 on the Y-axis positive side of the contact part 42. The inclined part 41*a* inclines to the Z-axis positive side toward the Y-axis negative side.

Figure 5:
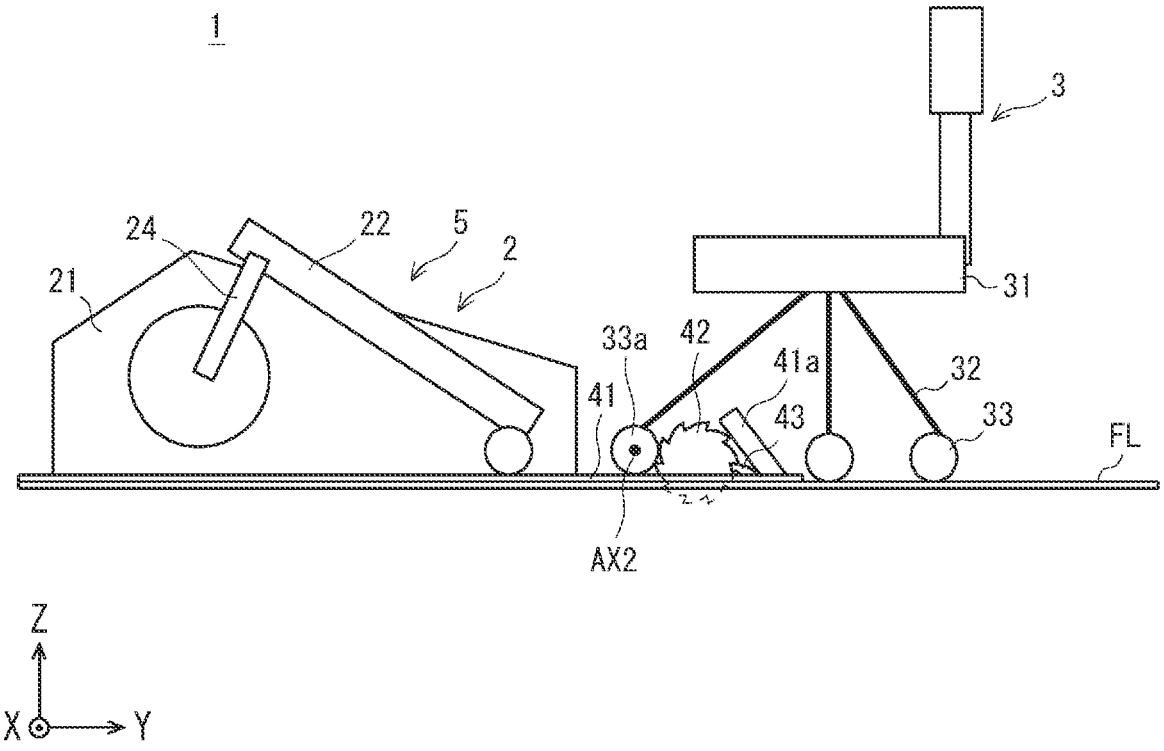
FIG. 5 is a side view for describing an arrangement relationship between elements when a user performs a lower limb exercise using the lower limb exercise system according to the first embodiment.

Next, a flow in which the user U performs a lower limb exercise using the lower limb exercise system 1 according to this embodiment will be described. FIG. 5 is a side view for describing an arrangement relationship between elements when a user performs a lower limb exercise using the lower limb exercise system according to this embodiment.

First, the user U moves the chair 3 to the Y-axis negative side so that one caster 33*a* on the Y-axis negative side of the chair 3 goes over the contact part 42 of the restriction mechanism 4 to the Y-axis negative side, and as shown in FIG. 5, the caster 33*a* is arranged on the Y-axis negative side of the contact part 42 of the restriction mechanism 4.

At this time, since the contact part 42 is allowed to rotate counterclockwise as viewed from the X-axis positive side, when the caster 33*a* of the chair 3 goes over the contact part 42, the contact part 42 is rotated counterclockwise and does not prevent the caster 33*a* from going over the contact part 42 to the Y-axis negative side. In addition, when the inclined part 41*a* is formed in the base part 41, the caster 33*a* can easily go over the contact part 42 to the Y-axis negative side.

Next, the user U moves the chair 3 to the Y-axis positive side to bring the caster 33*a* of the chair 3 into contact with the contact part 42 of the restriction mechanism 4, and arranges the caster 33*a* inside the reference arrangement range A1. At this time, the end of the contact part 42 on the Z-axis positive side is arranged on the Z-axis positive side of the center (i.e., rotation axis AX2) of the caster 33*a*.

In some embodiments, a rotation axis AX2 of the caster 33*a* may be arranged inside the reference arrangement range A1 be arranged in the approximately X-axis direction and that the approximately center of the width dimension of the caster 33*a* in the X-axis direction be arranged on the central axis AX1 of the exercise equipment 2.

In this state, the user U sits on the seat surface 31 of the chair 3 and performs a lower limb exercise by pedaling the first pedal 22 and the second pedal 23 of the exercise equipment 2. At this time, the chair 3 is about to be moved to the Y-axis positive side, but the clockwise rotation of the contact part 42 as viewed from the X-axis positive side is restricted. Therefore, the movement of the caster 33*a* of the chair 3 to the Y-axis positive side is restricted.

This restricts the movement of the caster 33*a* of the chair 3 from the reference arrangement range A1 to the Y-axis positive side by the contact part 42. Therefore, the user U can favorably pedal the first pedal 22 and the second pedal 23 of the exercise equipment 2 by a reaction force of the base part 41, and as a result, the user U can effectively perform lower limb exercises.

Moreover, with the caster 33*a* of the chair 3 arranged inside the reference arrangement range A1, the end of the contact part 42 on the Z-axis positive side is arranged on the Z-axis positive side of the center of the caster 33*a*. Therefore, it is possible to suppress the caster 33*a* from going over the contact part 42 to the Y-axis positive side, and it is possible to surely restrict the movement of the chair 3 on the Y-axis positive side.

At this time, if the rotation axis of the contact part 42 is arranged on the Z-axis positive side of the center of the caster 33*a* of the chair 3, it is possible to more surely suppress the caster 33*a* from going over the contact part 42 to the Y-axis positive side.

Figure 6:
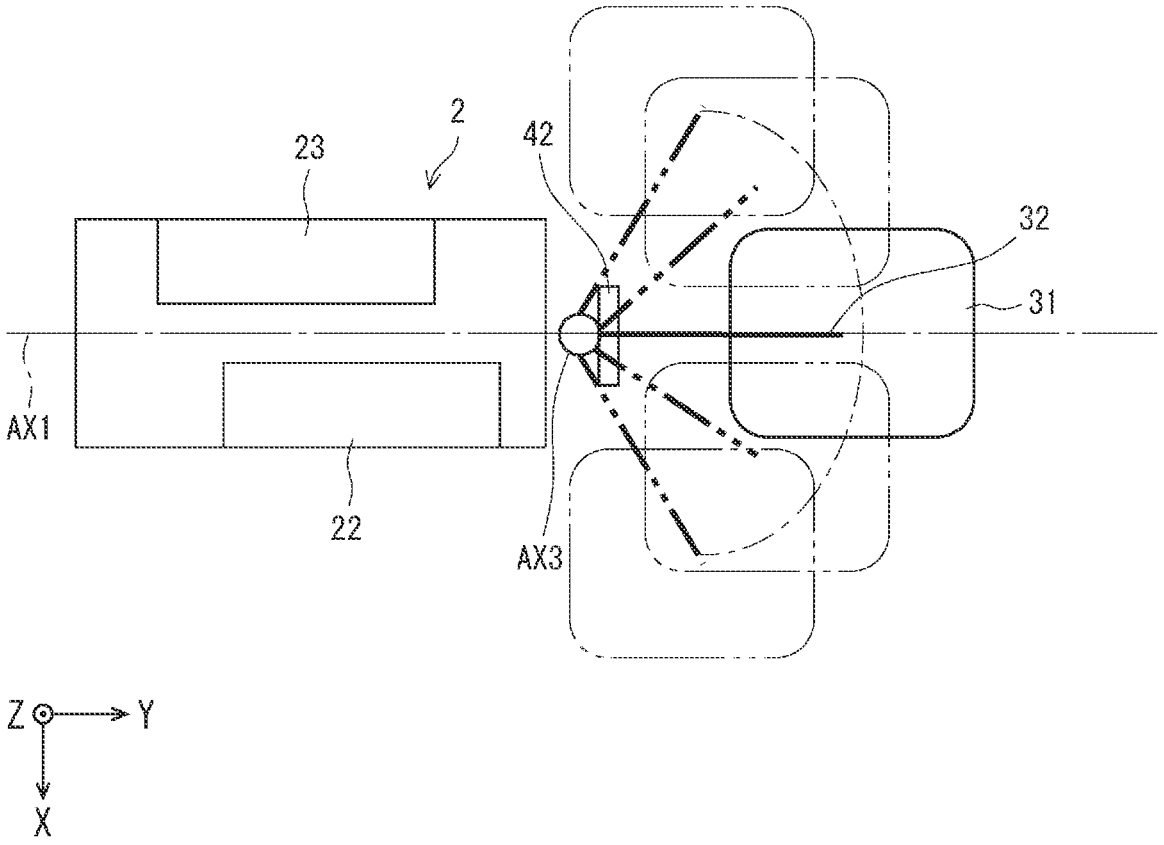
FIG. 6 is a plan view for describing a movement of a seat surface of a chair when the user performs a lower limb exercise by pedaling the first and second pedals of the exercise equipment.

Here, FIG. 6 is a plan view for describing the movement of the seat surface of the chair when the user performs a lower limb exercise by pedaling the first and second pedals of the exercise equipment. When the casters 33 of the chair 3 are composed of free casters, if the user U performs a lower limb exercise by pedaling the first pedal 22 and the second pedal 23 of the exercise equipment 2 with one caster 33*a* on the Y-axis negative side of the chair 3 in contact with the contact part 42 as described above, the seat surface 31 is moved in an arc around a pivot axis AX3 extending in the Z-axis direction of the caster 33*a*, as shown in FIG. 6.

This enables continuous exercises even if the relative positional relationship between the exercise equipment 2 and the chair 3 changes. Further, since the distance between the seat surface 31 and the first pedal 22 and the second pedal 23 changes, the load on the trunk is large and the exercise effect can be improved.

When the lower limb exercise is finished and the chair 3 is moved to the Y-axis positive side of the exercise equipment 2 to separate the exercise equipment 2 and the chair 3, the user U moves the chair 3 to the Y-axis positive side so that the caster 33*a* of the chair 3 goes over the contact part 42 to the Y-axis positive side, because a space on the Z-axis positive side of the restriction mechanism 4 is opened, so that the exercise equipment 2 and the chair 3 can be easily separated.

Although the restriction mechanism 4 according to this embodiment is fixed to the exercise equipment 2 through the base part 41, it may be detachably coupled to the exercise equipment 2. In addition, the restriction mechanism 4 according to this embodiment includes the contact part 42 and the claw part 43 constituting a ratchet mechanism. Alternatively, the contact part may be configured as a one-way clutch. In some embodiments, in this case, the surface of the contact part is covered with a friction material such as rubber or silicon.

Second Embodiment

Figure 7:
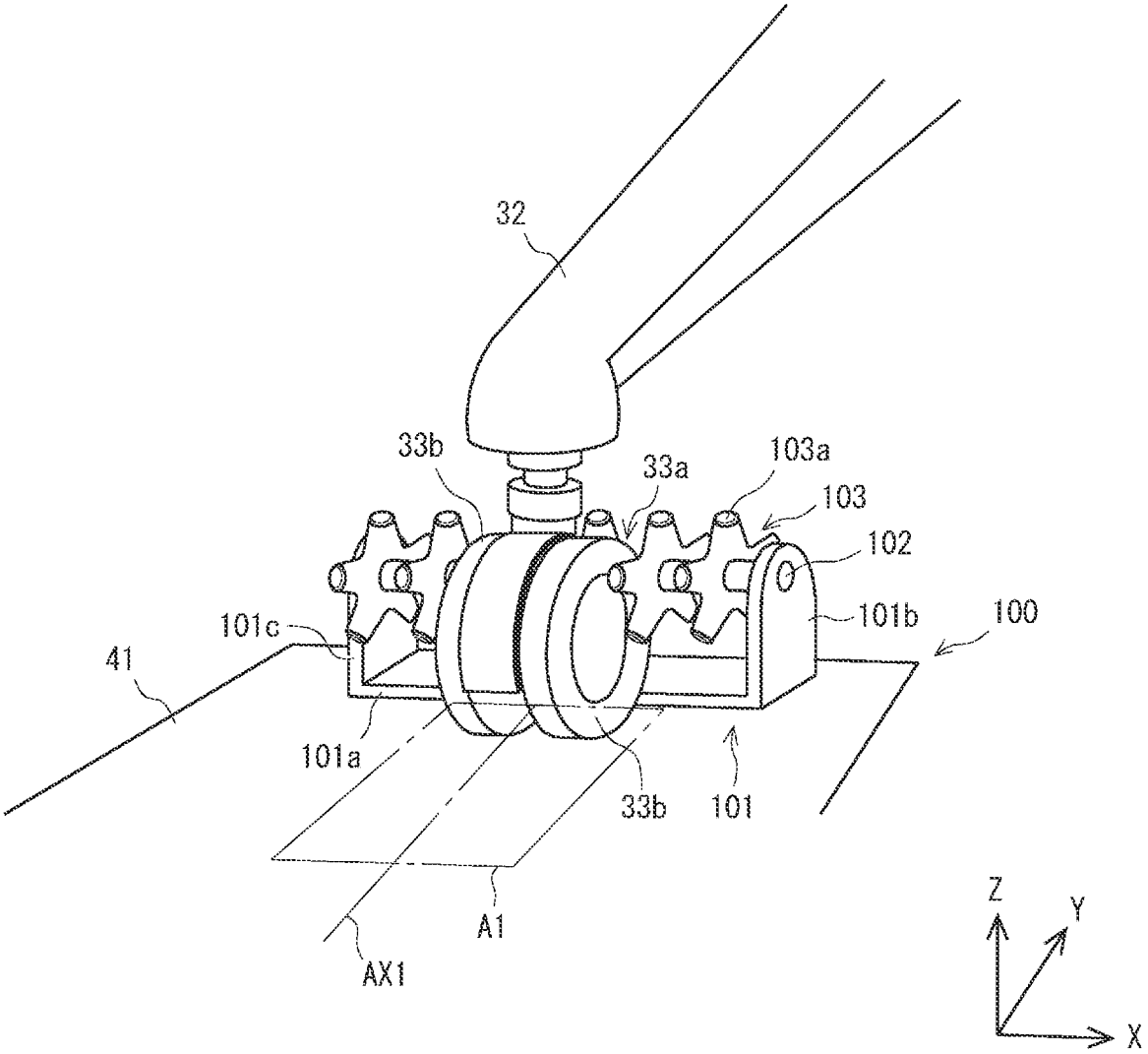
FIG. 7 is a perspective view showing a specific configuration of a restriction mechanism according to a second embodiment.

FIG. 7 is a perspective view showing a specific configuration of a restriction mechanism according to this embodiment. As shown in FIG. 7, a restriction mechanism 100 according to this embodiment includes a fixed part 101, a shaft 102, and contact parts 103 in addition to the base part 41. The position of the restriction mechanism 100 relative to the exercise equipment 2 is constrained in the region on the Y-axis positive side of the exercise equipment 2.

When viewed from the Y-axis direction, the fixed part 101 is approximately C-shaped with the Z-axis positive side open and includes a base part 101*a*, a first sidewall part 101*b* projecting from the end of the base part 101*a* on the X-axis positive side to the Z-axis positive side, and a second sidewall part 101*c* projecting from the end of the base part 101*a* on the X-axis negative side to the Z-axis positive side. The fixed part 101 is fixed to the base part 41.

The shaft 102 extends in the X-axis direction. The end of the shaft 102 on the X-axis positive side is fixed to the first sidewall part 101*b*, and the end of the shaft 102 on the X-axis negative side is fixed to the second sidewall part 101*c*. The contact parts 103 are passed through the shaft 102 and fixed to the shaft 102. A plurality of the contact part 103 are arranged in the X-axis direction.

At this time, the contact parts 103 are arranged near the end of the reference arrangement range A1 of the caster 33*a* of the chair 3 on the Y-axis positive side. When viewed from the Y-axis direction, the contact parts 103 are arranged in a range wider than the width dimension of the caster 33*a* of the chair 3 in the X-axis direction. In some embodiments, the caster 33 includes two wheels 33*b* arranged in the direction in which the rotation axis AX2 extends.

The contact part 103 is made of an elastic body and is a plate member having rigidity enough not to deform in the X-axis direction. Each of the contact parts 103 includes, for example, projections 103*a* projecting in the radial direction of the shaft 102. The projections 103*a* are spaced approximately equally in the circumferential direction of the shaft 102. However, the shape of the contact part 103 is not limited and may be circular or polygonal when viewed from the X-axis direction.

When the user U performs a lower limb exercise using such a restriction mechanism 100, the user U moves the chair 3 to the Y-axis negative side so that the caster 33*a* of the chair 3 goes over the contact part 103 to the Y-axis negative side. At this time, since the contact part 103 is made of an elastic body, it is deformed when the caster 33*a* goes over and does not inhibit the movement of the caster 33*a* to the Y-axis negative side. In this way, the caster 33*a* can be arranged on the Y-axis negative side of the contact part 103.

Next, the user U moves the caster 33*a* of the chair 3 to the Y-axis positive side to bring the caster 33*a* into contact with the contact part 103, and the caster 33*a* is arranged inside the reference arrangement range A1. At this time, the end of the contact part 103 on the Z-axis positive side is arranged on the Z-axis positive side of the center of the caster 33*a*.

Here, the contact part 103 in contact with the caster 33*a* of the chair 3 is deformed to the Y-axis positive side, and the contact part 103 not in contact with the caster 33*a* is not deformed to the Y-axis positive side. Therefore, the contact part 103 arranged between the wheels 33*b* of the caster 33*a* when viewed from the Y-axis direction enters between the wheels 33*b*, and each wheel 33*b* is surrounded by the contact part 103 from the X-axis positive side, Y-axis positive side, and X-axis negative side.

In such a state, when the user U performs a lower limb exercise, the caster 33*a* of the chair 3 pushes the contact part 103 to the Y-axis positive side. However, since the contact part 103 is made of an elastic body, it is deformed and absorbs the movement of the caster 33*a* to the Y-axis positive side. Furthermore, the end of the contact part 103 on the Z-axis positive side is arranged on the Z-axis positive side of the center of the caster 33*a*.

Therefore, it is possible to suppress the caster 33*a* of the chair 3 from going over the contact part 103 to the Y-axis positive side, and to restrict the movement of the caster 33*a* from the reference arrangement range A1 to the Y-axis positive side. Here, when the shaft 102 is arranged on the Z-axis positive side of the center of the caster 33*a* of the chair 3, the caster 33*a* can be more reliably suppressed from going over the contact part 103 to the Y-axis positive side. Moreover, since each wheel 33*b* is sandwiched by the contact parts 103 from the X-axis direction, the movement of the caster 33*a* from the reference arrangement range A1 in the X-axis direction can also be restricted.

In some embodiments, a projection may be formed to cross the central axis AX1 of the exercise equipment 2 in the region on the Y-axis negative side of the reference arrangement range A1 at the base part 41. This also restricts the movement of the caster 33*a* of the chair 3 from the reference arrangement range A1 to the Y-axis negative side. The projection may be shaped to restrict the movement of the caster 33*a* of the chair 3 to the Y-axis negative side.

When the lower limb exercise is finished and the chair 3 is moved to the Y-axis positive side of the exercise equipment 2 to separate the exercise equipment 2 and the chair 3, the user U moves the chair 3 to the Y-axis positive side so that the caster 33*a* of the chair 3 goes over the contact part 103 to the Y-axis positive side, because a space on the Z-axis positive side of the restriction mechanism 100 is opened, so that the exercise equipment 2 and the chair 3 can be easily separated.

Although the restriction mechanism 100 according to this embodiment is fixed to the exercise equipment 2 through the base part 41, it may be detachably coupled to the exercise equipment 2.

Third Embodiment

Figure 8:
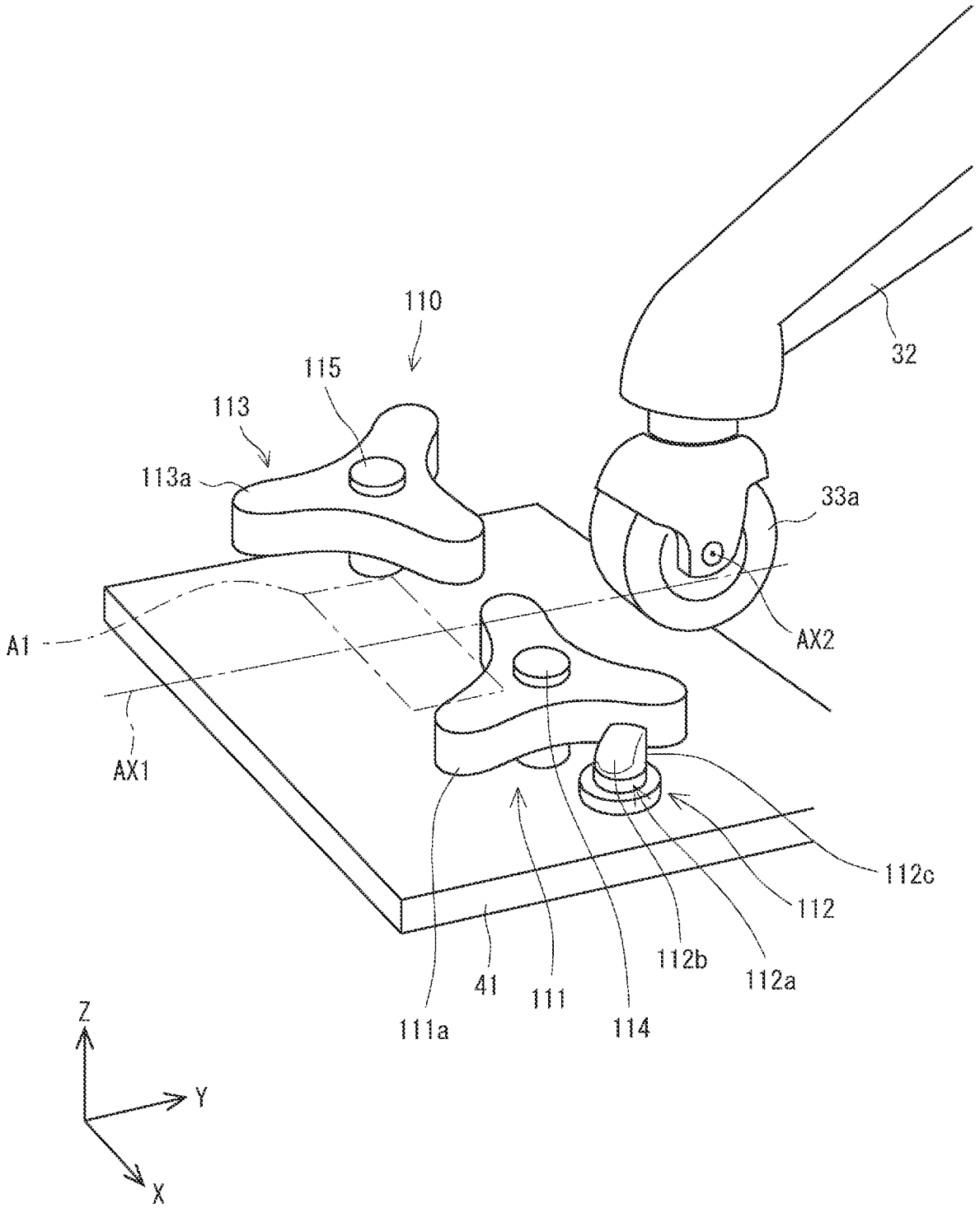
FIG. 8 is a perspective view showing a specific configuration of a restriction mechanism according to a third embodiment.

FIG. 8 is a perspective view showing a specific configuration of a restriction mechanism according to this embodiment. As shown in FIG. 8, a restriction mechanism 110 according to this embodiment includes a first contact part 111, a first lock mechanism 112, a second contact part 113, and a second lock mechanism (not shown) in addition to the base part 41. The position of the restriction mechanism 110 relative to the exercise equipment 2 is constrained in the region on the Y-axis positive side of the exercise equipment 2.

The first contact part 111 is, for example, a rotating member supported by the base part 41 so as to be able to rotate around a first rotation axis 114 projecting from the base part 41 to the Z-axis positive side. The first contact part 111 is positioned on the Y-axis positive side of the reference arrangement range A1 of the caster 33*a* of the chair 3 and near the corner thereof on the X-axis positive side. The first contact part 111 includes, for example, projections 111*a* projecting in the radial direction of the first rotation axis 114 at approximately equal intervals in the circumferential direction of the first rotation axis 114.

As viewed from the Z-axis positive side, the first lock mechanism 112 allows counterclockwise rotation of the first contact part 111 and restricts clockwise rotation of the first contact part 111. The first lock mechanism 112 includes, for example, a locking claw 112*a* energized to the Z-axis positive side.

The locking claw 112*a* includes an inclined surface 112*b* inclined to the Z-axis positive side in the counterclockwise direction of the first contact part 111. The locking claw 112*a* includes a vertical surface 112*c* approximately parallel to the Z-axis at the end of the first contact part 111 in the locking claw 112*a* on the counterclockwise direction side.

Since the second contact part 113 and the second lock mechanism have a bilaterally symmetric configuration with the central axis AX1 of the exercise equipment 2 as the axis of symmetry with respect to the first contact part 111 and the first lock mechanism 112, a detailed description is omitted. The second contact part 13 and the second lock mechanism are arranged on the X-axis negative side of the first contact part 111 and the first lock mechanism 112.

The second contact part 113 has projections 113*a* and is a rotating member supported by the base part 41 so as to be able to rotate around a second rotation axis 115. The second contact part 113 is arranged on the Y-axis positive side of the reference arrangement range A1 of the caster 33*a* of the chair 3 and near the corner thereof on the X-axis negative side.

At this time, with the projections 111*a* of the first contact part 111 and the projections 113*a* of the second contact part 113 arranged so as to face each other in the X-axis direction, the first contact part 111 and the second contact part 113 are arranged at a distance that the caster 33*a* of the chair 3 cannot pass between the projections 111*a* of the first contact part 111 and the projections 113*a* of the second contact part 113.

As viewed from the Z-axis positive side, the second lock mechanism allows clockwise rotation of the second contact part 113 and restricts counterclockwise rotation of the second contact part 113. When the user U performs a lower limb exercise using such a restriction mechanism 110, the user U pushes one caster 33*a* on the Y-axis negative side of the chair 3 between the first contact part 111 and the second contact part 113 to the Y-axis negative side.

At this time, the first lock mechanism 112 allows counterclockwise rotation of the first contact part 111 and the second lock mechanism allows clockwise rotation of the second contact part 113. Therefore, the first contact part 111 and the second contact part 113 rotate to allow movements of the caster 33*a* to the Y-axis negative side. Thus, the caster 33*a* of the chair 3 can be arranged on the Y-axis negative side of the first contact part 111 and the second contact part 113.

Next, the user U moves the caster 33*a* of the chair 3 to the Y-axis positive side to bring the caster 33*a* in contact with the projections 111*a* projecting to the X-axis negative side of the first contact part 111 and the projections 113*a* projecting to the X-axis positive side of the second contact part 113 and to arrange the caster 33*a* inside the reference arrangement range A1.

At this time, the end of the projection 111*a* of the first contact part 111 on the Z-axis positive side and the end of the projection 113*a* of the second contact part 113 on the Z-axis positive side are arranged on the Z-axis positive side of the center of the caster 33*a*. Also, the caster 33*a* is arranged between the projection 111*a* projecting to the Y-axis negative side in the first contact part 111 and the projection 113*a* projecting to the Y-axis negative side in the second contact part 113.

In such a state, when the user U performs a lower limb exercise, the caster 33*a* of the chair 3 pushes the first contact part 111 and the second contact part 113 to the Y-axis positive side. However, the first lock mechanism 112 restricts clockwise rotation of the first contact part 111 and the second lock mechanism restricts counterclockwise rotation of the second contact part 113. Therefore, the rotation of the first contact part 111 and the second contact part 113 is restricted.

Moreover, the end of the projection 111*a* of the first contact part 111 on the Z-axis positive side and the end of the projection 113*a* of the second contact part 113 on the Z-axis positive side are arranged on the Z-axis positive side of the center of the caster 33*a*. Therefore, the movement of the caster 33*a* from the reference arrangement range A1 to the Y-axis positive side can be restricted.

In addition, the movement of the caster 33*a* from the reference arrangement range A1 in the X-axis direction can also be restricted, because the caster 33*a* of the chair 3 is sandwiched in the X-axis direction between the projection 111*a* projecting to the Y-axis negative side in the first contact part 111 and the projection 113*a* projecting to the Y-axis negative side in the second contact part 113.

In some embodiments, a projection may be formed to cross the central axis AX1 of the exercise equipment 2 in the region on the Y-axis negative side of the reference arrangement range A1 at the base part 41. This also restricts the movement of the caster 33*a* of the chair 3 from the reference arrangement range A1 to the Y-axis negative side. The projection may be shaped to restrict the movement of the caster 33*a* of the chair 3 to the Y-axis negative side.

When the lower limb exercise is finished and the chair 3 is moved to the Y-axis positive side of the exercise equipment 2 to separate the exercise equipment 2 and the chair 3, the exercise equipment 2 and the chair 3 can be easily separated if the user U moves the chair 3 to the Y-axis positive side while pulling up the caster 33*a* to the Z-axis positive side, because a space on the Z-axis positive side of the restriction mechanism 110 is open.

Although the restriction mechanism 110 according to this embodiment is fixed to the exercise equipment 2 through the base part 41, it may be detachably coupled to the exercise equipment 2. The first contact part 111 and the second contact part 113 according to this embodiment are configured so that rotation thereof is restricted by the first lock mechanism 112 and the second lock mechanism, and instead they may be configured as one-way clutches. The surfaces of the contact parts may be covered with a friction material such as rubber or silicon.

Fourth Embodiment

Figure 9:
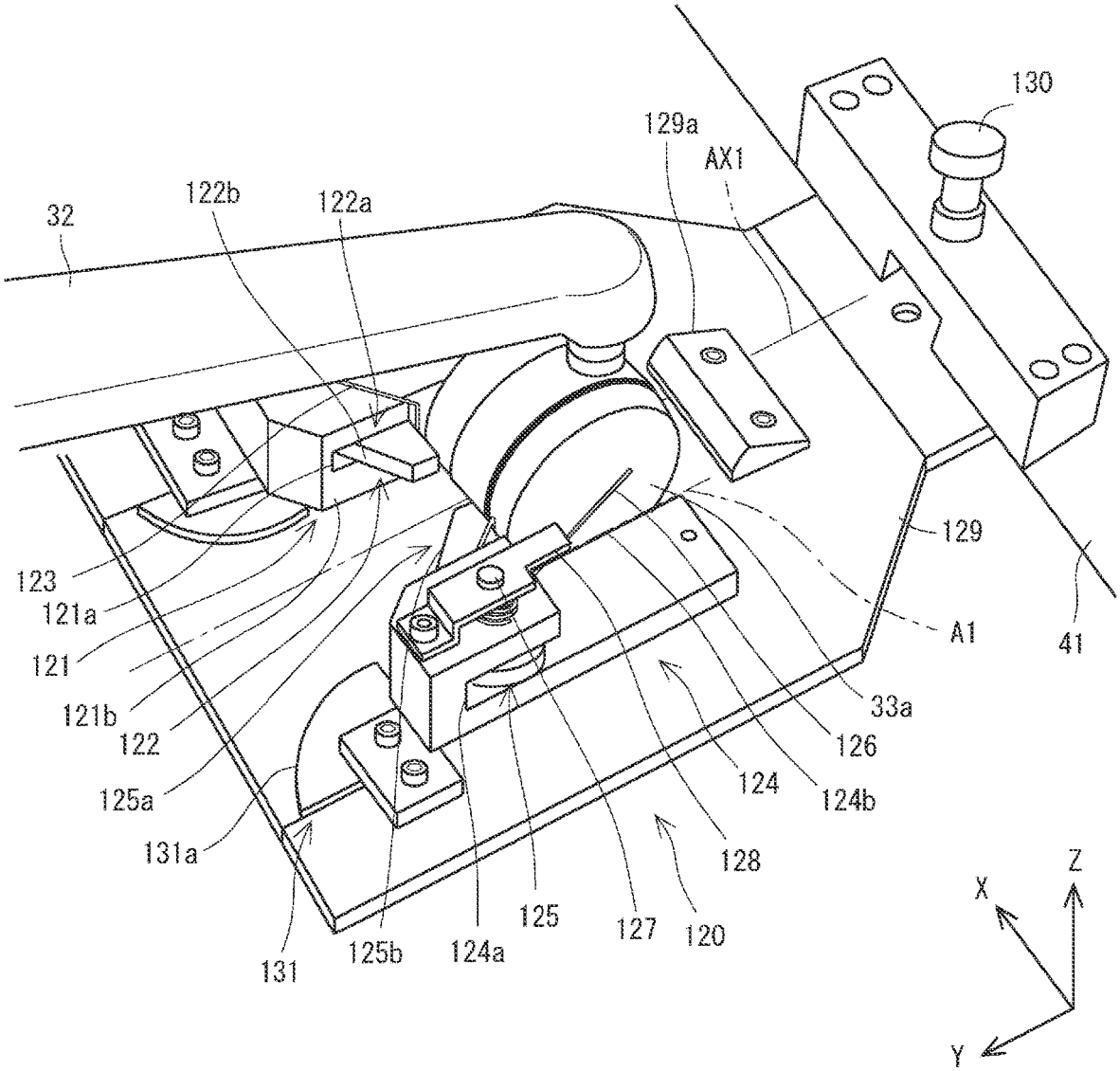
FIG. 9 is a perspective view showing a specific configuration of a restriction mechanism according to a fourth embodiment.

FIG. 9 is a perspective view showing a specific configuration of a restriction mechanism according to this embodiment. As shown in FIG. 9, a restriction mechanism 120 according to this embodiment includes a first restriction part 121, a first contact part 122, a first elastic body 123, a second restriction part 124, a second contact part 125, and a second elastic body 126 in addition to the base part 41. The position of the restriction mechanism 120 relative to the exercise equipment 2 is constrained in the region on the Y-axis positive side of the exercise equipment 2.

The first restriction part 121 has, for example, an approximately C-shaped block member as a basic configuration when viewed from the X-axis direction, and includes a notched part 121*a* with the Y-axis negative side thereof open at a part of the first restriction part 121 on the Y-axis positive side. The first restriction part 121 includes a restriction surface 121*b* approximately parallel to the YZ plane at the end of the first restriction part 121 on the X-axis negative side.

The first contact part 122 is arranged inside the notched part 121*a* of the first restriction part 121 and is a rotating member supported by the first restriction part 121 rotatably around the first rotation axis extending in the Z-axis direction. The first contact part 122 includes a projection 122*a* projecting to the X-axis negative side from the notched part 121*a* of the first restriction part 121.

The projection 122*a* is, for example, an approximately right-angled trapezoidal plate member when viewed from the Z-axis positive side, and includes an inclined surface 122*b* formed at the end of the projection 122*a* on the clockwise direction side of the first contact part 122. The inclined surface 122*b* is inclined in the counterclockwise direction of the first contact part 122 toward radially outward of the first rotation axis.

The first elastic body 123 energizes the first contact part 122 clockwise when viewed from the Z-axis positive side. In some embodiments, at this time, the first elastic body 123 is composed of a torsion spring. With the first elastic body 123 passed through the first rotation axis, one end of the first elastic body 123 is hooked to the end of the projection 122*a* of the first contact part 122 on the counterclockwise direction side.

The other end of the first elastic body 123 is arranged on the Y-axis negative side of the one end of the first elastic body 123, and is hooked from the X-axis negative side to a first hook piece provided in the first restriction part 121. However, the first elastic body 123 may have another configuration as long as it is configured to energize the first contact part 122 clockwise as viewed from the Z-axis positive side.

In such a configuration, in the initial state of the restriction mechanism 120, the first contact part 122 is energized clockwise by the first elastic body 123 with the projection 122*a* of the first contact part 122 projecting from the notched part 121*a* of the first restriction part 121 to the X-axis negative side, while the end of the first contact part 122 on the clockwise direction side is in contact with the first restriction part 121 to restrict clockwise rotation.

The second restriction part 124, the second contact part 125, and the second elastic body 126 are arranged on the X-axis negative side of the first restriction part 121, the first contact part 122, and the first elastic body 123, although a detailed description is omitted, because they are symmetrical with respect to the central axis AX1 of the exercise equipment 2 as the axis of symmetry with respect to the first restriction part 121, the first contact part 122, and the first elastic body 123, respectively.

The second restriction part 124 includes a notched part 124*a* and a restriction surface 124*b*. In some embodiments, a distance between the restriction surface 121*b* of the first restriction part 121 and the restriction surface 124*b* of the second restriction part 124 in the X-axis direction is approximately equal to the width dimension of the caster 33 of the chair 3 in the X-axis direction.

The second contact part 125 includes a projection 125*a* projecting from the notched part 124*a* of the second restriction part 124 to the X-axis positive side and is a rotating member supported by the second restriction part 124 so as to be rotatable about the second rotation axis 127. The projection 125*a* includes an inclined surface 125*b* inclined in the clockwise direction of the second contact part 125 toward radially outward of the second rotation axis 127.

Here, in the initial state where the projection 122*a* of the first contact part 122 and the projection 125*a* of the second contact part 125 are arranged so as to face each other in the X-axis direction, the first contact part 122 and the second contact part 125 are arranged between the projection 122*a* of the first contact part 122 and the projection 125*a* of the second contact part 125 with a space that the caster 33 of the chair 3 cannot pass therethrough.

Further, in the initial state where the projection 122*a* of the first contact part 122 and the projection 125*a* of the second contact part 125 are arranged to face each other in the X-axis direction, the reference arrangement range A1 of the caster 33*a* of the chair 3 is arranged inside the restriction surface 121*b* of the first restriction part 121, the projection 122*a* of the first contact part 122, the projection 125*a* of the second contact part 125, and the restriction surface 124*b* of the second restriction part 124.

As viewed from the Z-axis positive side, in a state where the second elastic body 126 is passed through the second rotation axis 127 so that the second contact part 125 is energized counterclockwise, one end of the second elastic body 126 is hooked to the projection 125*a* of the second contact part 125 and the other end of the second elastic body 126 is hooked to the second hook piece 128 provided in the second restriction part 124 so as to energize the second contact part 125 counterclockwise. However, the second elastic body 126 may have another configuration as long as it is configured to energize the second contact part 125 counterclockwise as viewed from the Z-axis positive side.

When the user U performs a lower limb exercise using such a restriction mechanism 120, the user U pushes one caster 33*a* on the Y-axis negative side of the chair 3 between the first restriction part 121 and the second restriction part 124 on the Y-axis negative side. Thus, the first contact part 122 and the second contact part 125 rotate to allow the caster 33*a* to move to the Y-axis negative side.

When the user U arranges the caster 33*a* on the Y-axis negative side of the chair 3 of the first contact part 122 and the second contact part 125, the first contact part 122 and the second contact part 125 return to their initial states by energizing forces of the first elastic body 123 and the second elastic body 126. As a result, the projection 122*a* of the first contact part 122 and the projection 125*a* of the second contact part 125 are arranged on the Y-axis positive side of the caster 33*a* of the chair 3.

Next, the user U moves the caster 33*a* of the chair 3 to the Y-axis positive side to bring the caster 33*a* into contact with the projection 122*a* of the first contact part 122 and the projection 125*a* of the second contact part 125, and arranges the caster 33*a* inside the reference arrangement range A1. Here, the end of the projection 122*a* of the first contact part 122 on the Z-axis positive side and the end of the projection 125*a* of the second contact part 125 on the Z-axis positive side are arranged on the Z-axis positive side of the center of the caster 33*a* of the chair 3.

In such a state, when the user U performs a lower limb exercise, the caster 33*a* of the chair 3 pushes the first contact part 122 and the second contact part 125 to the Y-axis positive side. However, as described above, the clockwise rotation of the first contact part 122 is restricted by the first restriction part 121 and the counterclockwise rotation of the second contact part 125 is restricted by the second restriction part 124. Therefore, the rotation of the first contact part 122 and the second contact part 125 is restricted.

Moreover, the end of the projection 122*a* of the first contact part 122 on the Z-axis positive side and the end of the projection 125*a* of the second contact part 125 on the Z-axis positive side are arranged on the Z-axis positive side of the center of the caster 33*a* of the chair 3. Therefore, the movement of the caster 33*a* from the reference arrangement range A1 to the Y-axis positive side can be restricted.

Furthermore, since the caster 33*a* of the chair 3 is sandwiched between the restriction surface 121*b* of the first restriction part 121 and the restriction surface 124*b* of the second restriction part 124 in the X-axis direction, the movement of the caster 33*a* from the reference arrangement range A1 in the X-axis direction can also be restricted.

When the lower limb exercise is finished and the chair 3 is moved to the Y-axis positive side of the exercise equipment 2 to separate the exercise equipment 2 and the chair 3, the exercise equipment 2 and the chair 3 can be easily separated if the user U moves the chair 3 to the Y-axis positive side while pulling up the caster 33*a* of the chair 3 to the Z-axis positive side, because a space on the Z-axis positive side of the restriction mechanism 120 is open.

In some embodiments, the restriction mechanism 120 may be configured to be detachable from the exercise equipment 2. In some embodiments, that is, the length of the base part (first base part) 41 in the Y-axis direction is shorter than that of the base part 41 according to the first embodiment or the like. Further, in some embodiments, the second base part 129 provided with the first restriction part 121, the first contact part 122, the first elastic body 123, the second restriction part 124, the second contact part 125, and the second elastic body 126 can be coupled to the end of the first base part 41 on the Y-axis positive side by using, for example, a detachable mechanism 130 such as a bolt.

In this way, the part provided with the first restriction part 121, the first contact part 122, the first elastic body 123, the second restriction part 124, the second contact part 125, and the second elastic body 126 in the restriction mechanism 120 can be easily detached from the exercise equipment 2, thereby improving the versatility of the exercise equipment 2.

However, the first restriction part 121, the first contact part 122, the first elastic body 123, the second restriction part 124, the second contact part 125, and the second elastic body 126 may be provided in the base part 41 in the same way as that in the first embodiment.

In some embodiments, a projection 129*a* may be formed to cross the central axis AX1 of the exercise equipment 2 in the region of the reference arrangement range A1 on the Y-axis negative side in the second base part 129. This also restricts the movement of the caster 33*a* from the reference arrangement range A1 to the Y-axis negative side.

In some embodiments, the restriction mechanism 120 includes a guide part 131 for guiding the caster 33*a* of the chair 3 between the restriction surface 121*b* of the first restriction part 121 and the restriction surface 124*b* of the second restriction part 124. The guide part 131 includes a guide surface 131*a* whose width dimension in the X-axis direction is narrowed toward the Y-axis negative side. With such a configuration, the caster 33*a* of the chair 3 can be easily pushed between the restriction surface 121*b* of the first restriction part 121 and the restriction surface 124*b* of the second restriction part 124.

Fifth Embodiment

Figure 10:
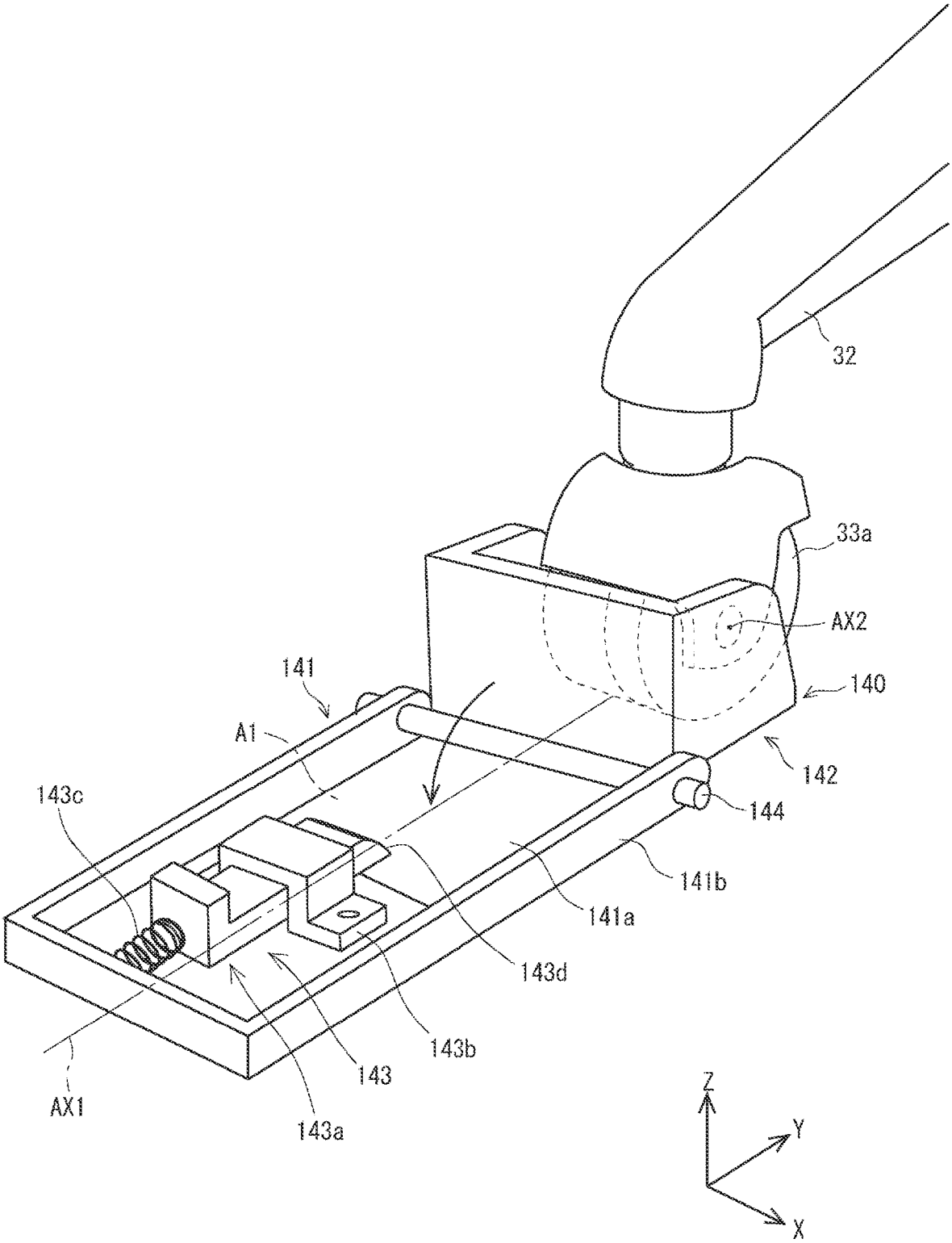
FIG. 10 is a perspective view showing a specific configuration of a restriction mechanism according to a fifth embodiment.

FIG. 10 is a perspective view showing a specific configuration of a restriction mechanism according to this embodiment. As shown in FIG. 10, a restriction mechanism 140 according to this embodiment includes a second base part 141, a housing part 142, and a lock mechanism 143 in addition to the base part (first base part) 41. The position of the restriction mechanism 140 relative to the exercise equipment 2 is constrained in the region on the Y-axis positive side of the exercise equipment 2.

The second base part 141 includes a bottom part 141*a* and sidewall parts 141*b* and is fixed to the first base part 41 in a state where it is arranged, for example, on a surface of the first base part 41 on the Z-axis positive side. The bottom part 141*a* is, for example, an approximately rectangular plate member when viewed from the Z-axis direction, and has a step shape in which a height of a part of the bottom part 141*a* on the Y-axis negative side is greater than a part thereof on the Y-axis positive side. At this time, the reference arrangement range A1 of the caster 33*a* of the chair 3 is arranged at the part of the bottom part 141*a* on the Y-axis positive side when viewed from the Z-axis direction.

The sidewall parts 141*b* project from the end of the bottom part 141*a* on the X-axis negative side, the end thereof on the Y-axis negative side, and the end thereof on the X-axis positive side toward the Z-axis positive side. That is, the sidewall parts 141*b* are arranged along the periphery of the bottom part 141*a* except for the end of the bottom part 141*a* on the Y-axis positive side.

The housing part 142 is a box member with a part of the housing part 142 on the Y-axis positive side and a part thereof on the Z-axis positive side open in the initial state shown in FIG. 10. As shown in FIG. 10, the housing part 142 can house the caster 33*a* of the chair 3 inside the housing part 142.

Such a housing part 142 is supported by the second base part 141 on the Y-axis negative side of the housing part 142 in the initial state, as shown in FIG. 10, rotatably around the rotation axis 144 provided at the corner on the Z-axis negative side.

The rotation axis 144 extends in the X-axis direction and is inserted into the end of the sidewall part 141*b* on the Y-axis positive side of the part of the sidewall part 141*b* in the second base part 141 on the X-axis positive side and the end of the sidewall part 141 on the Y-axis positive side of the part of the sidewall part 141*b* in the second base part 141 on the X-axis negative side. At this time, the housing part 142 is arranged so as to have a bilaterally symmetric configuration with the central axis AX1 of the exercise equipment 2 as the axis of symmetry.

The lock mechanism 143 has a claw part 143*a*, a guide part 143*b*, and an elastic body 143*c*. The claw part 143*a* is, for example, an approximately L-shaped block member as viewed from the X-axis direction, and has an inclined surface 143*d* at the end of the claw part 143*a* on the Y-axis positive side.

The inclined surface 143*d* is inclined to the Z-axis positive side toward the Y-axis negative side. Such a claw part 143*a* is arranged on a part of the bottom part 141*a* on the Y-axis negative side in the second base part 141 and extends in the Y-axis direction. At this time, in the initial state of the restriction mechanism 140 shown in FIG. 10, the inclined surface 143*d* of the claw part 143*a* projects to the part of the second base part 141 on the Y-axis positive side.

The guide part 143*b* is an approximately C-shaped block member when viewed from the Y-axis direction. An inner shape of the guide part 143*b* is approximately equal to an outer shape of the part of the claw part 143*a* extending in the Y-axis direction.

The guide part 143*b* is fixed to the part of the bottom part 141*a* on the Y-axis negative side in the second base part 141 with the part of the claw part 143*a* extending in the Y-axis direction passed through the inside of the guide part 143*b*. At this time, the part of the claw part 143*a* extending in the Z-axis direction is arranged on the Y-axis negative side of the guide part 143*b*.

The elastic body 143*c* is arranged between the part of the sidewall part 141*b* on the Y-axis negative side in the second base part 141 and the part of the claw part 143*a* on the Z-axis direction, and energizes the claw part 143*a* to the Y-axis positive side.

When the user U performs a lower limb exercise using such a restriction mechanism 140, the user U moves one caster 33*a* on the Y-axis negative side of the chair 3 to the Y-axis negative side and houses it inside the housing part 142. When the user U further moves the caster 33*a* of the chair 3 to the Y-axis negative side, the housing part 142 rotates counterclockwise as viewed from the X-axis positive side.

At this time, since the inclined surface 143*d* of the claw part 143*a* is inclined to the Z-axis positive side toward the Y-axis negative side, the housing part 142 pushes the claw part 143*a* to the Y-axis negative side while the housing part 142 is in contact with the inclined surface 143*d* of the claw part 143*a*.

When the housing part 142 is arranged on the part of the bottom 141*a* on the Y-axis positive side in the second base part 141, the part of the housing part 142 on the Z-axis negative side (i.e., a part thereof approximately parallel to the XY plane) is arranged at a lower position in the Z-axis direction than the position of the part of the bottom part 141*a* on the Y-axis negative side in the second base part 141.

Therefore, the claw part 143*a* is pushed out to the Y-axis positive side by the elastic body 143*c*, and the end of the claw part 143*a* on the Y-axis positive side covers the end of the housing part 142 on the Y-axis negative side in the part thereof on the Z-axis negative side. This restricts the rotation of the housing part 142, and the housing part 142 surrounds the caster 33*a* of the chair 3 from the X-axis positive side, Y-axis positive side, and X-axis negative side.

After that, the caster 33*a* of the chair 3 is moved to the Y-axis positive side to be in contact with the part of the housing part 142 on the Y-axis positive side, and the caster 33*a* is arranged inside the reference arrangement range A1. At this time, the end of the housing part 142 on the Z-axis positive side part in the part thereof on the Y-axis positive side is arranged on the Z-axis positive side of the center of the caster 33*a* of the chair 3.

In such a state, when the user U performs a lower limb exercise, the caster 33*a* of the chair 3 pushes the housing part 142 to the Y-axis positive side. However, as described above, the rotation of the housing part 142 is restricted by the claw part 143*a*. Moreover, the end of the housing part 142 on the Y-axis positive side in the part of the housing part 142 on the Z-axis positive side is arranged on the Z-axis positive side of the center of the caster 33*a* of the chair 3.

Therefore, the movement of the caster 33*a* from the reference arrangement range A1 to the Y-axis positive side can be restricted. Further, since the caster 33*a* is sandwiched between the part of the housing part 142 on the X-axis positive side and the part thereof on the X-axis negative side in the X-axis direction, the movement of the caster 33*a* from the reference arrangement range A1 in the X-axis direction can also be restricted.

When the lower limb exercise is finished and the chair 3 is moved to the Y-axis positive side of the exercise equipment 2 to separate the exercise equipment 2 and the chair 3, the exercise equipment 2 and the chair 3 can be easily separated if the user U pushes the claw part 143*a* to the Y-axis negative side to allow the rotation of the housing part 142 and moves the chair 3 to the Y-axis positive side.

Although the restriction mechanism 140 according to this embodiment is fixed to the exercise equipment 2 through the first base part 41, it may be detachably coupled to the exercise equipment 2.

Sixth Embodiment

Figure 11:
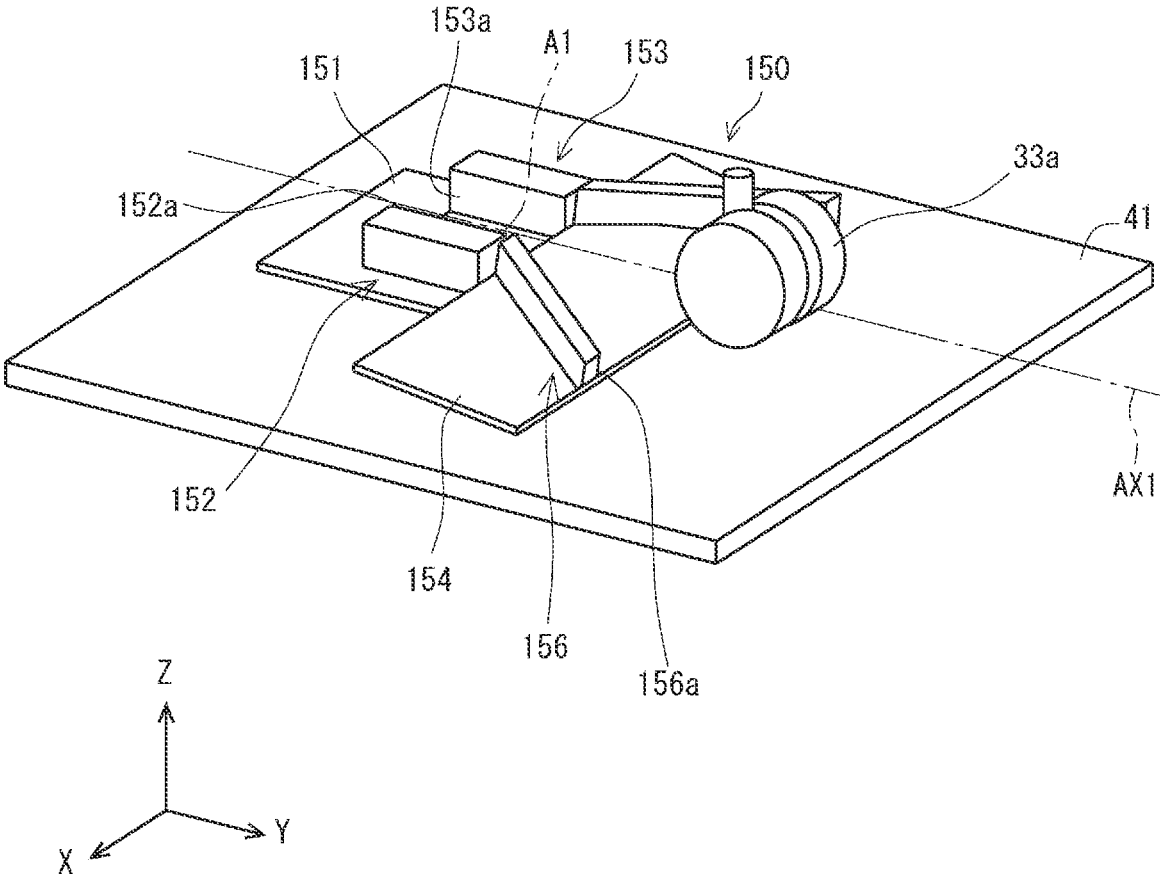
FIG. 11 is a perspective view showing a specific configuration of a restriction mechanism according to a sixth embodiment.
Figure 12:
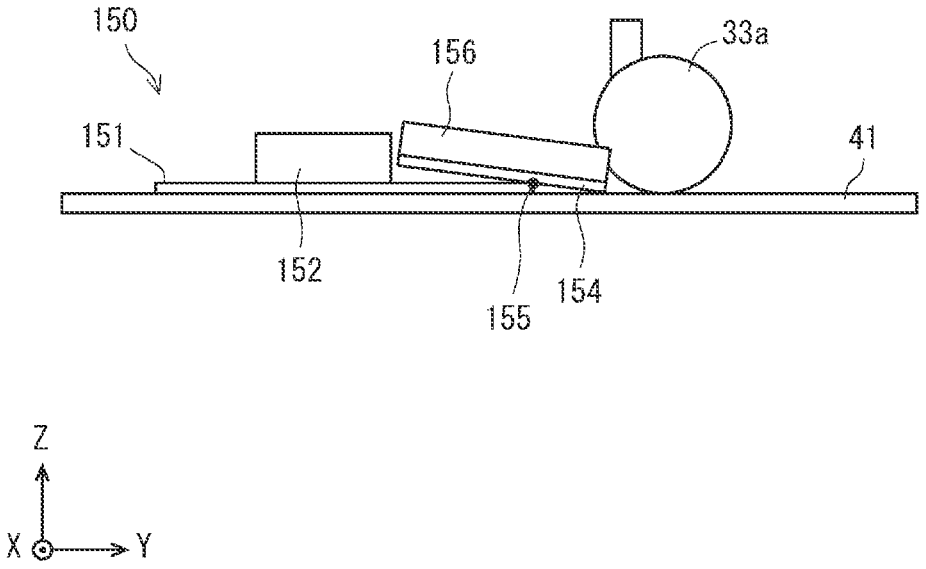
FIG. 12 is a side view showing the specific configuration of the restriction mechanism according to the sixth embodiment.

FIG. 11 is a perspective view showing a specific configuration of a restriction mechanism according to this embodiment. FIG. 12 is a side view showing a specific configuration of a restriction mechanism according to this embodiment. As shown in FIGS. 11 and 12, a restriction mechanism 150 according to this embodiment includes a second base part 151, a first restriction part 152, a second restriction part 153, a movable plate 154, and an elastic body in addition to the base part (first base part) 41. The position of the restriction mechanism 150 relative to the exercise equipment 2 is constrained in the region on the Y-axis positive side of the exercise equipment 2.

The second base part 151 is, for example, an approximately rectangular plate member viewed from the Z-axis positive side, and is fixed to the first base part 41 in a state it is arranged on the surface of the first base part 41 on the Z-axis positive side. The first restriction part 152 is an approximately rectangular block member extending in the Y-axis direction and has a restriction surface 152*a* approximately parallel to the YZ plane at the end of the first restriction part 152 on the X-axis negative side.

The second restriction part 153 is arranged on the X-axis negative side of the first restriction part 152. The second restriction part 153 is an approximately rectangular block member extending in the Y-axis direction and has a restriction surface 153*a* approximately parallel to the YZ plane at the end of the second restriction part 153 on the X-axis positive side.

These first restriction part 152 and second restriction part 153 are fixed to the part of the second base part 151 on the Y-axis negative side so that the first restriction part 152 and the second restriction part 153 have a bilaterally symmetric configuration with the central axis AX1 of the exercise equipment 2 as the axis of symmetry. At this time, the distance between the first restriction part 152 and the second restriction part 153 in the X-axis direction should be approximately equal to the width dimension of the caster 33 of the chair 3 in the X-axis direction.

The movable plate 154 is an approximately rectangular plate member viewed from the Z-axis direction and is arranged so as to project from the second base part 151 to the Y-axis positive side. The movable plate 154 is supported by the second base part 151 rotatably around a rotation axis 155 provided at the end of the second base part 151 on the Y-axis positive side. The rotation axis 155 extends in the X-axis direction.

The elastic body energizes the movable plate 154 clockwise as viewed from the X-axis positive side. In some embodiments, the elastic body is composed of, for example, a torsion spring. With the elastic body passed through the rotation axis 155, one end of the elastic body is fixed to the second base part 151 and the other end of the elastic body is fixed to the movable plate 154.

However, the elastic body may have another configuration as long as it can energize the movable plate 154 clockwise as viewed from the X-axis positive side. In this embodiment, the elastic body energizes the movable plate 154 clockwise. Alternatively, a weight may be provided at the end of the movable plate 154 on the Y-axis positive side to energize the movable plate 154 clockwise.

In such a configuration, in the initial state of the restriction mechanism 150 shown in FIGS. 11 and 12, as viewed from the X-axis positive side, the movable plate 154 is rotated clockwise and arranged in a state inclined to the Z-axis negative direction toward the Y-axis positive direction. At this time, the reference arrangement range A1 of the caster 33*a* of the chair 3 is arranged inside the restriction surface 152*a* of the first restriction part 152, the movable plate 154, and the restriction surface 153*a* of the second restriction part 153.

When the user U performs a lower limb exercise using the restriction mechanism 150, the user U moves one caster 33*a* on the Y-axis negative side of the chair 3 in the Y-axis negative direction and places it on the movable plate 154. Then, the movable plate 154 is rotated counterclockwise as viewed from the X-axis positive side due to the weight of the caster 33*a* of the chair 3, and the surface of the movable plate 154 on the Z-axis negative side is in approximately plane contact with the surface of the second base part 151 on the Z-axis positive side, so that the movable plate 154 is arranged almost parallel to the XY plane.

The user U further moves the caster 33*a* of the chair 3 in the Y-axis negative direction to insert the caster 33*a* between the restriction surface 152*a* of the first restriction part 152 and the restriction surface 153*a* of the second restriction part 153, and to retreat the caster 33*a* from the surface of the movable plate 154 on the Z-axis positive side. At this time, since the movable plate 154 is energized clockwise as viewed from the X-axis positive side by the elastic body, the movable plate 154 returns to its initial state of clockwise rotation.

This restricts the counterclockwise rotation of the movable plate 154 as viewed from the X-axis positive side, and the caster 33*a* of the chair 3 is surrounded from the X-axis positive side, Y-axis positive side, and X-axis negative side by the restriction surface 152*a* of the first restriction part 152, the movable plate 154, and the restriction surface 153*a* of the second restriction part 153.

After that, the user U moves the caster 33*a* of the chair 3 in the Y-axis positive direction to bring the caster 33*a* into contact with the end of the movable plate 154 on the Y-axis negative side, and arranges the caster 33*a* inside the reference arrangement range A1. At this time, the end of the movable plate 154 on the Z-axis positive side is arranged on the Z-axis positive side of the center of the caster 33*a* of the chair 3.

In such a state, when the user U performs a lower limb exercise, the caster 33*a* pushes the movable plate 154 to the Y-axis positive side. However, the movable plate 154 is energized clockwise in the initial state of being rotated clockwise. Moreover, the end of the movable plate 154 on the Z-axis positive side is arranged on the Z-axis positive side of the center of the caster 33*a* of the chair 3.

Therefore, counterclockwise rotation of the movable plate 154 is restricted, and the movement of the caster 33*a* of the chair 3 from the reference arrangement range A1 to the Y-axis positive side can be restricted. Furthermore, since the caster 33*a* of the chair 3 is sandwiched between the restriction surface 152*a* of the first restriction part 152 and the restriction surface 153*a* of the second restriction part 153 from the X-axis direction, the movement of the caster 33*a* from the reference arrangement range A1 in the X-axis direction can also be restricted.

When the lower limb exercise is finished and the chair 3 is moved to the Y-axis positive side of the exercise equipment 2 to separate the exercise equipment 2 and the chair 3, for example, by providing an extended part extending in the X-axis positive direction on the movable plate 154 and the user U stepping on it to move the chair 3 in the Y-axis positive direction while rotating the movable plate 154 counterclockwise and arranging the movable plate 154 approximately parallel to the XY plane as viewed from the X-axis positive side, the chair 3 can be easily separated from the exercise equipment 2.

In some embodiments, the restriction mechanism 150 includes a guide part 156 for guiding the caster 33*a* of the chair 3 between the restriction surface 152*a* of the first restriction part 152 and the restriction surface 153*a* of the second restriction part 153.

The guide part 156 includes a guide surface 156*a* whose width dimension in the X-axis direction is narrowed toward the Y-axis negative side. With such a configuration, the caster 33*a* of the chair 3 can be easily pushed between the restriction surface 152*a* of the first restriction part 152 and the restriction surface 153*a* of the second restriction part 153.

Although the restriction mechanism 150 according to this embodiment is fixed to the exercise equipment 2 through the first base part 41, it may be detachably coupled to the exercise equipment 2.

Seventh Embodiment

Figure 13:
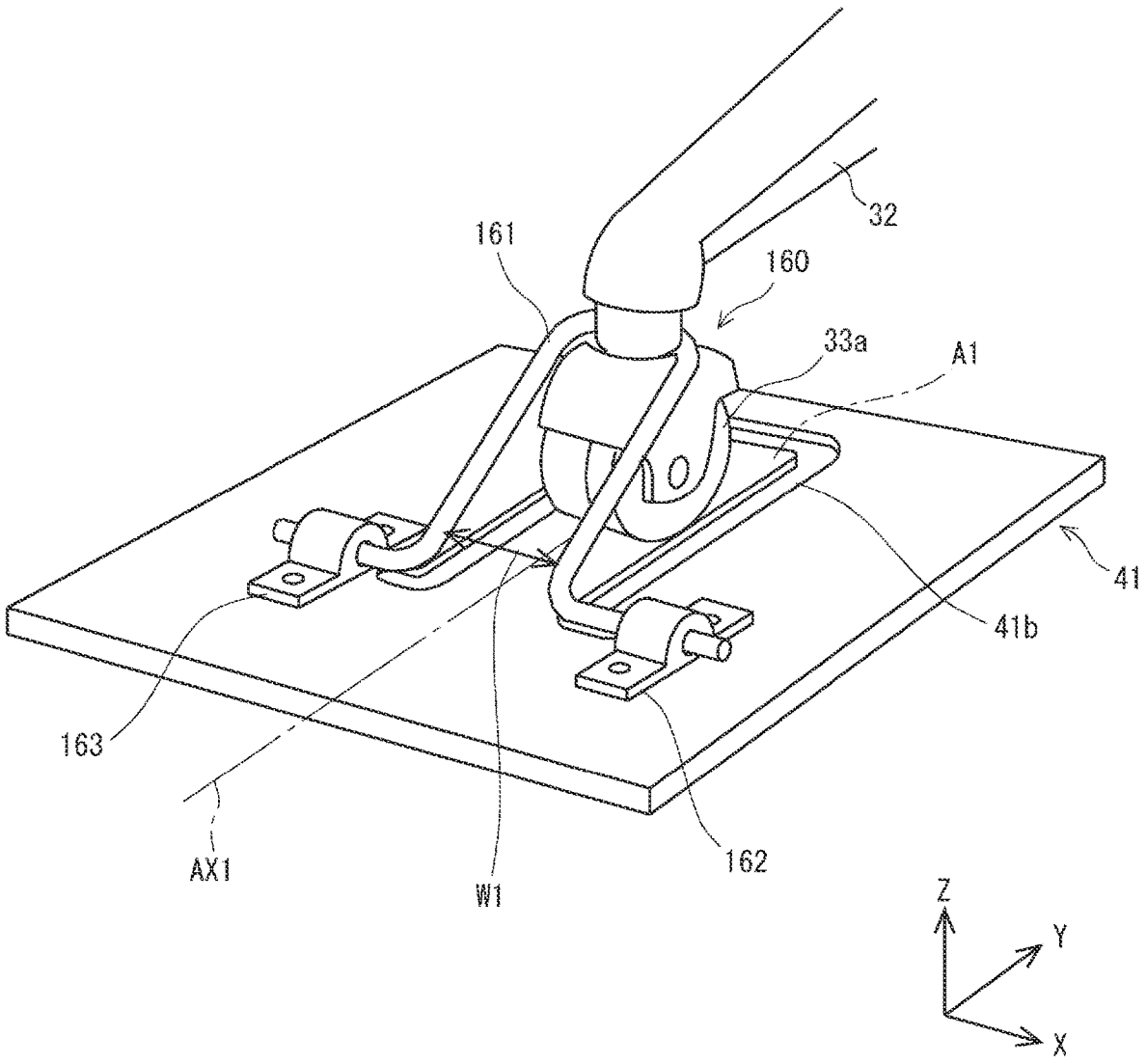
FIG. 13 is a perspective view showing a specific configuration of the restriction mechanism according to a seventh embodiment.

FIG. 13 is a perspective view showing a specific configuration of a restriction mechanism according to this embodiment. As shown in FIG. 13, a restriction mechanism 160 according to this embodiment includes a hook part 161 and an elastic body in addition to the base part 41. The position of the restriction mechanism 160 relative to the exercise equipment 2 is constrained in the region on the Y-axis positive side of the exercise equipment 2.

The hook part 161 is an approximately C-shaped linear member with the Y-axis negative side open as viewed from the Z-axis direction. In some embodiments, at this time, a width dimension W1 of the inside of the hook part 161 in the X-axis direction is approximately equal to the width dimension of the caster 33*a* of the chair 3 in the X-axis direction.

The end of the hook part 161 on the X-axis positive side is coupled to the base part 41 rotatably around the X-axis through a first fixing jig 162, and the end of the hook part 161 on the X-axis negative side is coupled to the base part 41 rotatably around the X-axis through a second fixing jig 163.

The hook part 161 extends from the first fixing jig 162 and the second fixing jig 163 to the Y-axis positive side. The hook part 161 is arranged so as to have a bilaterally symmetric configuration with the central axis AX1 of the exercise equipment 2 as the axis of symmetry.

In some embodiments, a recess 41*b* is formed in the base part 41 to house the hook part 161 with the hook part 161 arranged approximately parallel to the XY plane. At this time, the reference arrangement range A1 of the caster 33*a* of the chair 3 is arranged in the area inside the recess 41*b* as viewed from the Z-axis direction.

The elastic body energizes the hook part 161 counterclockwise as viewed from the X-axis positive side. In some embodiments, the elastic body is composed of, for example, a torsion spring. With the elastic body passed through the end of the hook part 161 on the X-axis negative side or the end of the hook part 161 on the X-axis positive side, one end of the elastic body is fixed to the hook part 161 and the other end of the elastic body is fixed to the base part 41. However, the elastic body only may have another configuration as long as it can energize the hook part 161 counterclockwise when viewed from the X-axis positive side.

With such a configuration, in the initial state of the restriction mechanism 160 shown in FIG. 13, when viewed from the X-axis positive side, the hook part 161 is rotated counterclockwise and arranged in a state in which it is inclined to the Z-axis positive side toward the Y-axis positive side.

When the user U performs a lower limb exercise using the restriction mechanism 160, in a state in which the user has rotated the hook part 161 clockwise as viewed from the X-axis positive side and housed in the recess 41*b* of the base part 41, one caster 33*a* on the Y-axis negative side of the chair 3 is moved to the Y-axis negative side, and the caster 33*a* is arranged in the region inside the recess 41*b* when viewed from the Z-axis direction.

Next, when the user U cancels the state in which the hook part 161 is rotated clockwise, the hook part 161 is rotated counterclockwise and returns to the initial state, because the elastic body is energizing the hook part 161 counterclockwise when viewed from the X-axis positive side.

Then, the caster 33*a* of the chair 3 is hooked from the Y-axis positive side to the hook part 161, the caster 33*a* is sandwiched by the hook part 161 from the X-axis direction, and the caster 33*a* is arranged inside the reference arrangement range A1. At this time, the end of the hook part 161 on the Z-axis positive side is arranged on the Z-axis positive side of the center of the caster 33*a* of the chair 3.

In such a state, when the user U performs a lower limb exercise, the caster 33*a* of the chair 3 pushes the hook part 161 to the Y-axis positive side. However, the clockwise rotation of the hook part 161 is restricted when viewed from the X-axis positive side, because the hook part 161 is energized counterclockwise by the elastic body. Moreover, the end of the hook part 161 on the Z-axis positive side is arranged on the Z-axis positive side of the center of the caster 33*a* of the chair 3.

Therefore, the hook part 161 maintains the state in which the caster 33*a* of the chair 3 is hooked, and the movement of the caster 33*a* from the reference arrangement range A1 to the Y-axis positive side can be restricted. Further, since the caster 33*a* is sandwiched from the X-axis direction by the hook part 161, the movement of the caster 33*a* from the reference arrangement range A1 to the X-axis direction can also be restricted.

When the lower limb exercise is finished and the chair 3 is moved to the Y-axis positive side of the exercise equipment 2 to separate the exercise equipment 2 and the chair 3, the exercise equipment 2 and the chair 3 can be separated easily if the user U rotates the hook part 161 clockwise as viewed from the X-axis positive side to house the recessed part 41*b* of the base part 41 while moving the chair 3 to the Y-axis positive side.

Although the restriction mechanism 160 according to this embodiment is fixed to the exercise equipment 2 through the base part 41, it may be detachably coupled to the exercise equipment 2.

Eighth Embodiment

Figure 14:
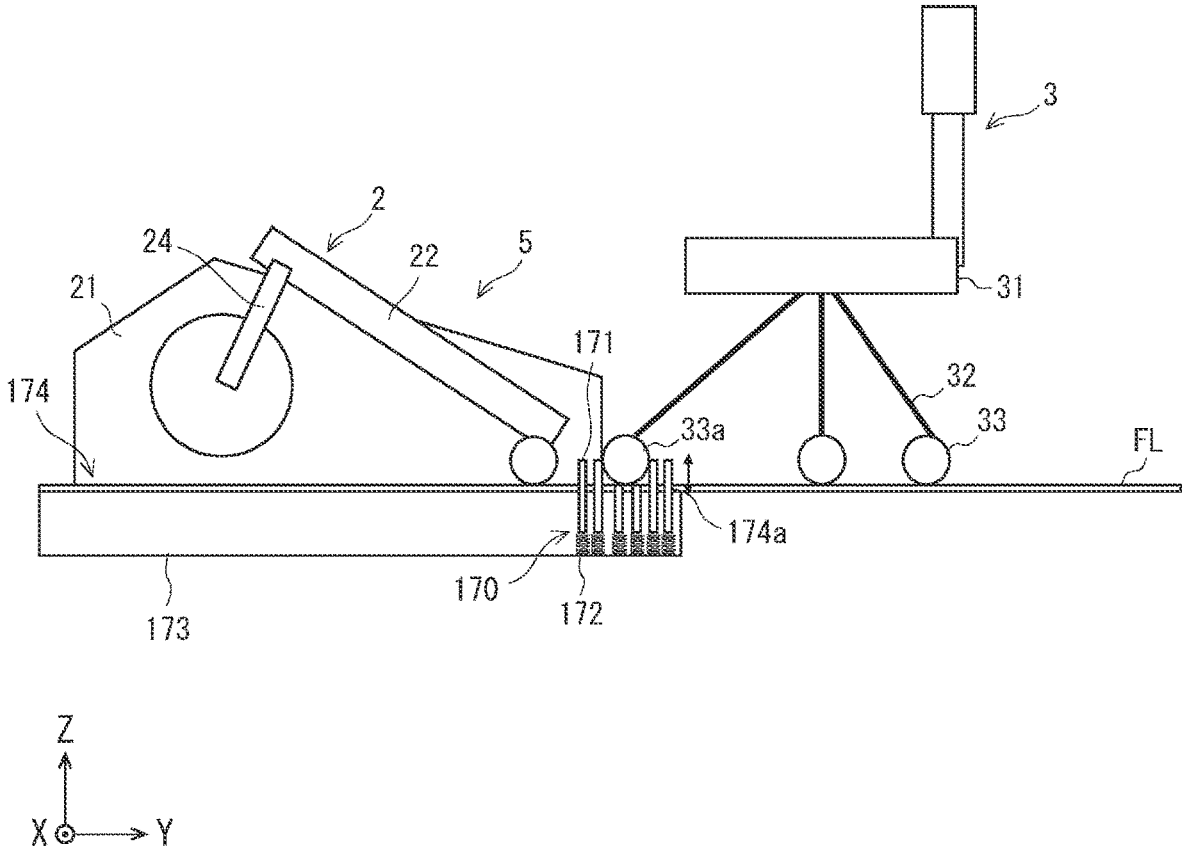
FIG. 14 is a side view showing a specific configuration of a restriction mechanism according to an eighth embodiment.

FIG. 14 is a side view showing a specific configuration of a restriction mechanism according to this embodiment. As shown in FIG. 14, a restriction mechanism 170 according to this embodiment includes movable plates 171 and an elastic body 172. The position of the restriction mechanism 170 relative to the exercise equipment 2 is constrained in the region on the Y-axis positive side of the exercise equipment 2.

The movable plates 171 are, for example, plate members that are approximately parallel to the XZ plane. A plurality of the movable plates 171 are arranged at intervals in the Y-axis direction. Here, in this embodiment, a recess 173 is formed in the floor surface FL of the facility, and when viewed from the Z-axis direction, a plurality of movable plates 171 are arranged in a region of the recess 173 in the exercise equipment 2 on the Y-axis positive side.

At this time, the movable plates 171 are arranged so as to have a bilaterally symmetric configuration with the central axis AX1 of the exercise equipment 2 as the axis of symmetry. When viewed from the Z-axis direction, the reference arrangement range A1 of the caster 33*a* of the chair 3 is arranged inside the arrangement region of the plurality of the movable plates 171.

That is, the recess 173 includes the reference arrangement range A1 of the caster 33*a* of the chair 3 when viewed from the Z-axis direction. The recess 173 is covered by a lid part 174. The lid part 174 has a plurality of through holes 174*a* arranged in the Y-axis direction, and the movable plates 171 are inserted into the respective through holes 174*a* in the Z-axis direction.

In some embodiments, at this time, the lid part 174 has a thickness in the Z-axis direction that can support the movable plates 171 in such a way that the movable plates 171 are not inclined in the Y-axis direction while they are inserted into the through holes 174*a*. The elastic body 172 is arranged inside the recess part 173 and energizes the movable plates 171 to the Z-axis positive side.

With such a configuration, in the initial state of the restriction mechanism 170, all the movable plates 171 project from the lid part 174 to the Z-axis positive side. When the user U performs a lower limb exercise using the restriction mechanism 170, for example, the user U pushes the movable plates 171 with his/her foot or the like to move the movable plates 171 to the Z-axis negative side to house the movable plates 171 inside of the recess part 173 while moving one caster 33*a* on the Y-axis negative side of the chair 3 to the Y-axis negative side to arrange it on the Z-axis positive side of the plurality of movable plates 171.

Next, when the user U releases his/her foot pushing the movable plates 171, the movable plates 171 on which the caster 33*a* is not arranged on the Z-axis positive side are moved to the Z-axis positive side to return to the initial state, because the movable plates 171 are energized to the Z-axis positive side by the elastic body 172.

Then, the caster 33*a* is sandwiched in the Y-axis direction by the movable plates 171 arranged on the Y-axis negative side of the caster 33*a* of the chair 3 and the movable plates 171 arranged on the Y-axis positive side of the caster 33*a*, and the caster 33*a* is arranged inside the reference arrangement range A1. At this time, the end of the movable plate 171 on the Z-axis positive side is arranged on the Z-axis positive side of the center of the caster 33*a* of the chair 3.

In such a state, when the user U performs a lower limb exercise, the caster 33*a* of the chair 3 pushes the movable plates 171 arranged on the Y-axis positive side of the caster 33*a* to the Y-axis positive side, but the movable plates 171 are energized to the Z-axis positive side by the elastic body 172.

As a result, the movement of the movable plates 171 to the Z-axis negative side is restricted, and the state in which the movable plates 171 project from the lid part 174 to the Z-axis positive side is maintained. Moreover, the end of the movable plate 171 on the Z-axis positive side is arranged on the Z-axis positive side of the center of the caster 33*a* of the chair 3.

Therefore, the movement of the caster 33*a* of the chair 3 from the reference arrangement range A1 to the Y-axis positive side can be restricted. Moreover, since the caster 33*a* is sandwiched from the Y-axis direction, the movement of the caster 33*a* from the reference arrangement range A1 to the Y-axis negative side can also be restricted.

When the lower limb exercise is finished and the chair 3 is moved to the Y-axis positive side of the exercise equipment 2 to separate the exercise equipment 2 and the chair 3, the exercise equipment 2 and the chair 3 can be easily separated if the user U pushes the movable plates 171 arranged on the Y-axis positive side of the caster 33*a* using his/her foot or the like to move the movable plates 171 to the Z-axis negative side and house them inside the recess part 173 while moving the chair 3 to the Y-axis positive side.

Ninth Embodiment

Figure 15:
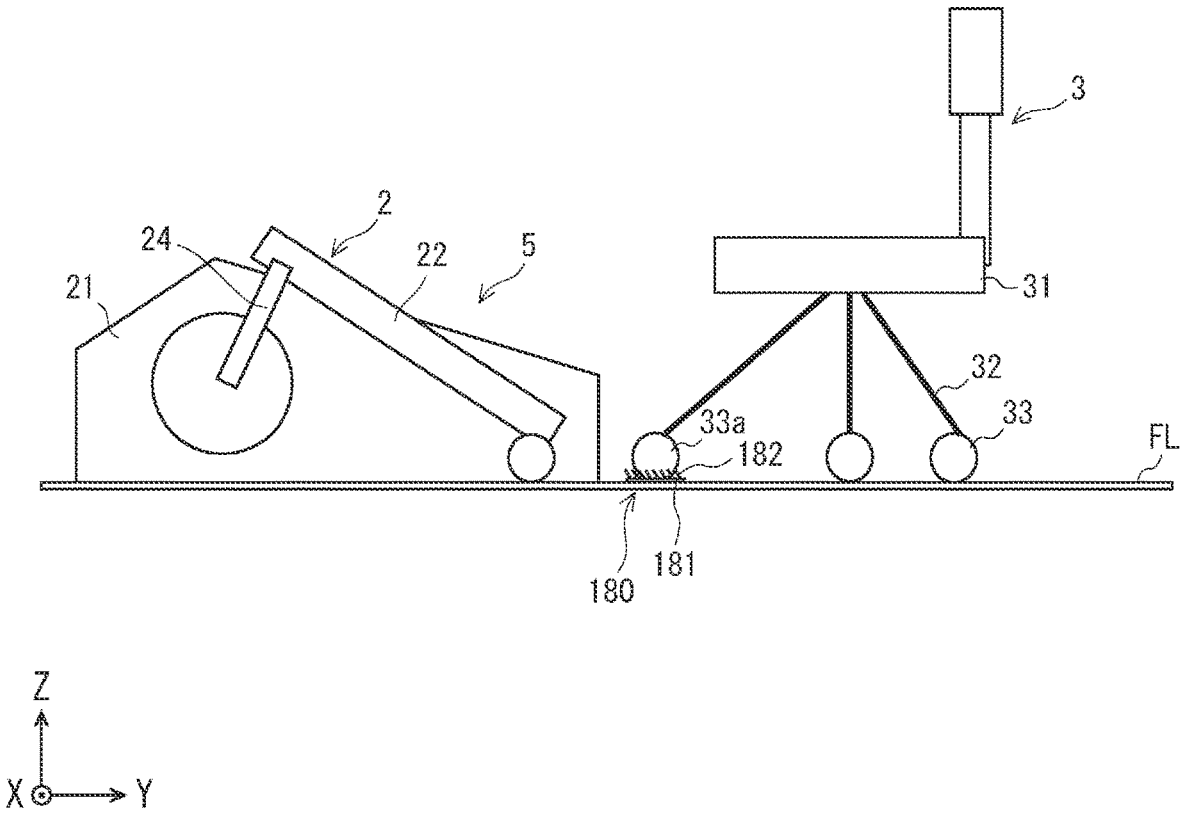
FIG. 15 is a side view showing a specific configuration of the restriction mechanism according to a ninth embodiment.

FIG. 15 is a side view showing a specific configuration of a restriction mechanism according to this embodiment. As shown in FIG. 15, a restriction mechanism 180 according to this embodiment includes a base part 181 and projections 182. The position of the restriction mechanism 180 relative to the exercise equipment 2 is constrained in the region on the Y-axis positive side of the exercise equipment 2.

The base part 181 is a plate member approximately parallel to the XY plane. Each of the projections 182 is, for example, a plate-shaped elastic member inclined to the Z-axis positive side toward the Y-axis negative side. The plurality of the projections 182 are fixed to the surface of the base part 181 on the Z-axis positive side at intervals in the Y-axis direction. However, each of the projections 182 is not limited to a plate shape and may be a pin shape. In some embodiments, the base part 181 and the projections 182 are integrally formed of an elastic material.

Such a restriction mechanism 180 may be fixed in a region on the Y-axis positive side of the exercise equipment 2 in the floor surface FL of the facility or may be fixed to a surface of the base part 41 on the Z-axis positive side so that, when viewed from the Z-axis direction, the restriction mechanism 180 is arranged in a region including the reference arrangement range A1 of the caster 33*a* of the chair 3.

When the user U performs a lower limb exercise using the restriction mechanism 180, for example, the user U moves one caster 33*a* on the Y-axis negative side of the chair 3 to the Y-axis negative side on the Z-axis positive side of the plurality of projections 182 to arrange it inside the reference arrangement range A1.

At this time, since the projection 182 is an elastic member, the projections 182 in which the caster 33*a* is not arranged on the Z-axis positive side return to the state of being inclined to the Z-axis positive side toward the Y-axis negative side. Also, the end of the projections 182 on the Z-axis positive side is arranged on the Z-axis positive side of the center of the caster 33*a* of the chair 3.

In such a state, when the user U performs a lower limb exercise, the caster 33*a* of the chair 3 pushes the projections 182 arranged on the Y-axis positive side of the caster 33*a* to the Y-axis positive side, but the projections 182 made of elastic members exert a counterclockwise restoring force when viewed from the Z-axis positive side.

This restricts the clockwise rotation of the projections 182 and maintains the projections 182 projecting from the base part 181 to the Z-axis positive side. Moreover, the end of the projections 182 on the Z-axis positive side is arranged on the Z-axis positive side of the center of the caster 33*a* of the chair 3. Therefore, the movement of the caster 33*a* from the reference arrangement range A1 to the Y-axis positive side can be restricted.

When the lower limb exercise is finished and the chair 3 is moved to the Y-axis positive side of the exercise equipment 2 to separate the exercise equipment 2 and the chair 3, the exercise equipment 2 and the chair 3 can be easily separated if the user U moves the caster 33*a* of the chair 3 to the Y-axis positive side while rotating counterclockwise the projections 182 arranged on the Y-axis positive side of the caster 33*a* using his/her foot or the like and pushing them down.

Tenth Embodiment

Figure 16:
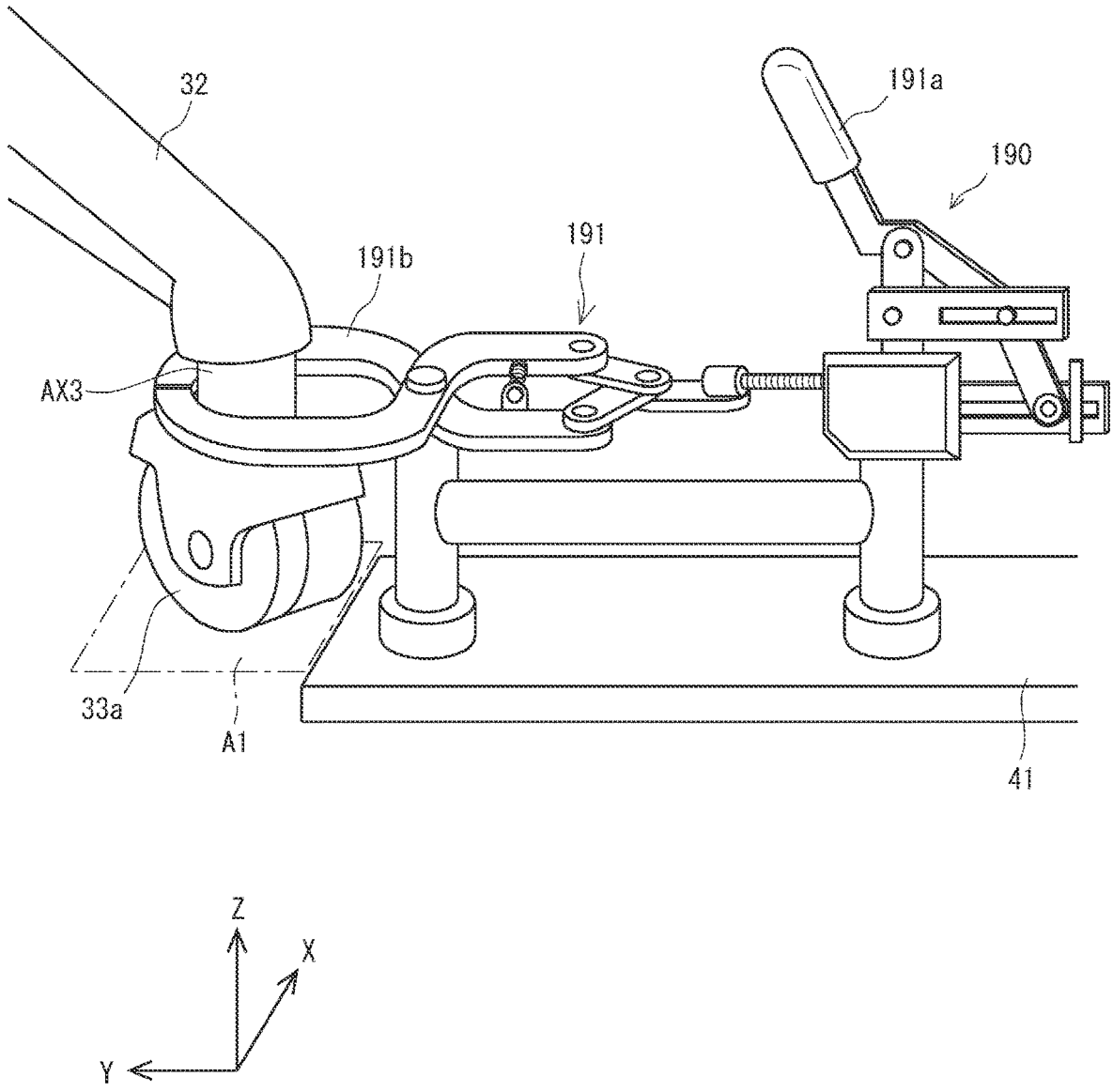
FIG. 16 is a perspective view showing a specific configuration of a restriction mechanism according to a tenth embodiment.

FIG. 16 is a perspective view showing a specific configuration of a restriction mechanism according to this embodiment. As shown in FIG. 16, a restriction mechanism 190 according to this embodiment includes a clamp mechanism 191 in addition to the base part 41. For example, by fixing the clamp mechanism 191 to the base part 41, the position of the restriction mechanism 190 relative to the exercise equipment 2 is constrained in the region on the Y-axis positive side of the exercise equipment 2.

The clamp mechanism 191 is composed of, for example, a general cam-type toggle clamp mechanism, and has a configuration in which a clamp part 191*b* is opened and closed by pushing and pulling a handle 191*a* in the Y-axis direction.

At this time, the clamp part 191*b* forms, when viewed from the Z-axis direction, a ring shape that can house the pivot axis AX3 of the caster 33*a* of the chair 3 while the clamp part 191*b* is closed. A region inside the clamp part 191*b* in a closed state when viewed from the Z-axis direction overlaps the reference arrangement range A1 of the caster 33*a* of the chair 3.

When the user U performs a lower limb exercise using such a restriction mechanism 190, the user U moves one caster 33*a* on the Y-axis negative side of the chair 3 to the Y-axis negative side and arranges the pivot axis AX3 of the caster 33*a* inside the clamp part 191*b* in an open state.

Next, the user U operates the handle 191*a* to close the clamp part 191*b*, moves the caster 33*a* of the chair 3 to the Y-axis positive side to bring the pivot axis AX3 of the caster 33*a* into contact with the end of the inner periphery of the clamp part 191*b* in a closed state on the Y-axis positive side, and arranges the caster 33*a* inside the reference arrangement range A1. At this time, the end of the clamp part 191*b* on the Z-axis positive side is arranged on the Z-axis positive side of the center of the caster 33*a*.

In such a state, when the user U performs a lower limb exercise, the pivot axis AX3 of the caster 33*a* of the chair 3 pushes the clamp part 191*b* of the clamp mechanism 191 to the Y-axis positive side, but the clamp part 191*b* is in the closed state. Moreover, the end of the clamp part 191*b* on the Z-axis positive side is arranged on the Z-axis positive side of the center of the caster 33*a*. Therefore, the movement of the caster 33*a* from the reference arrangement range A1 to the Y-axis positive side can be restricted.

When the lower limb exercise is finished and the chair 3 is moved to the Y-axis positive side of the exercise equipment 2 to separate the exercise equipment 2 and the chair 3, the exercise equipment 2 and the chair 3 can be easily separated if the user U operates the handle 191*a* of the clamp mechanism 191 to open the clamp part 191*b* and moves the chair 3 to the Y-axis positive side.

Figure 17:
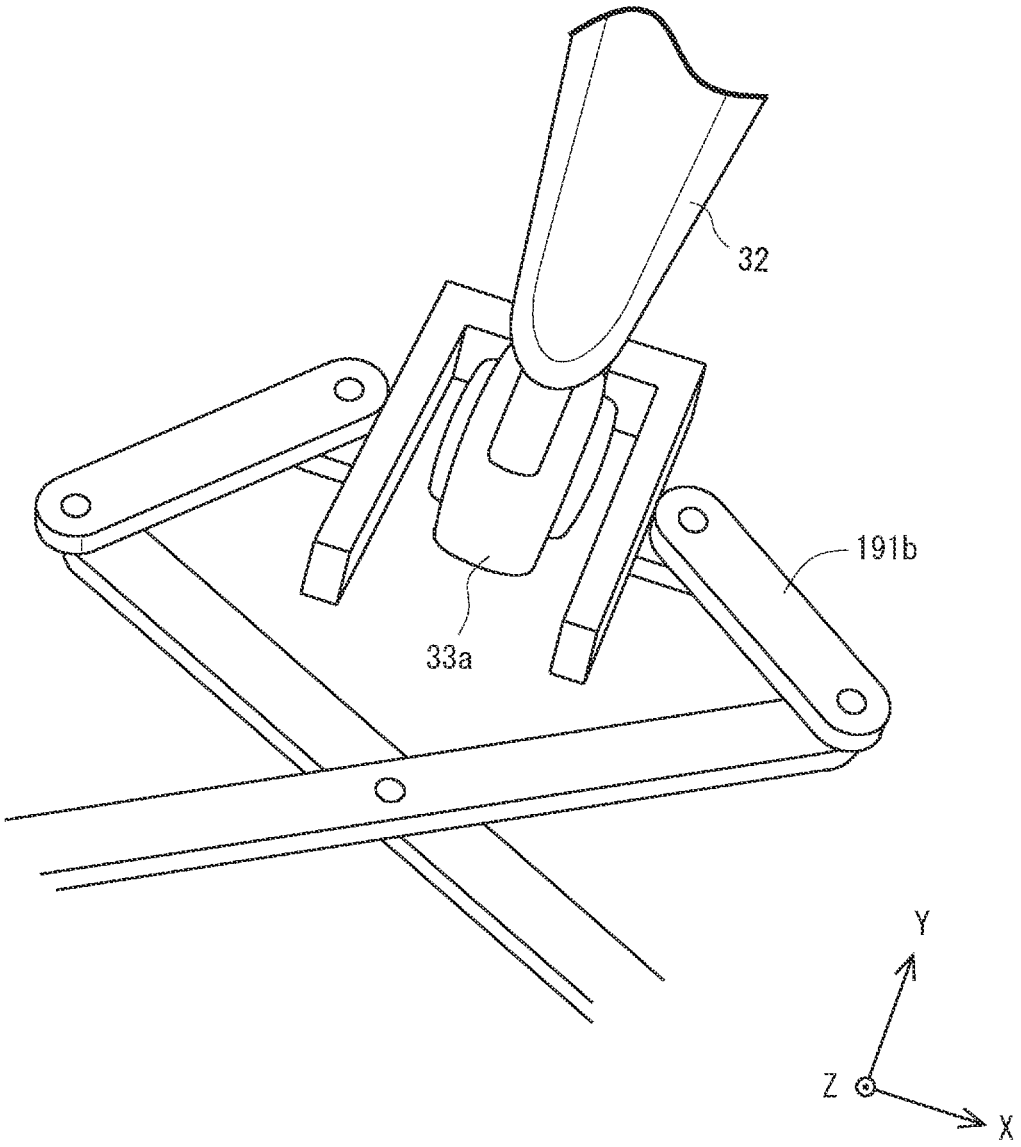
FIG. 17 is a plan view showing a specific configuration of different contact parts of the restriction mechanism according to the tenth embodiment.

Although the clamp part 191*b* of the clamp mechanism 191 according to this embodiment forms a ring shape in the closed state, as shown in FIG. 17, it may be configured to sandwich the caster 33*a* of the chair 3. Although the restriction mechanism 190 according to this embodiment is fixed to the exercise equipment 2 through the base part 41, it may be detachably coupled to the exercise equipment 2.

Another Embodiment

In the restriction mechanisms according to the above embodiments, for example, the contact part or the like is arranged based on the reference arrangement range A1 at one place of the caster 33*a* of the chair 3. Alternatively, a plurality of contact parts or the like may be arranged in the Y-axis direction.

Figure 18:
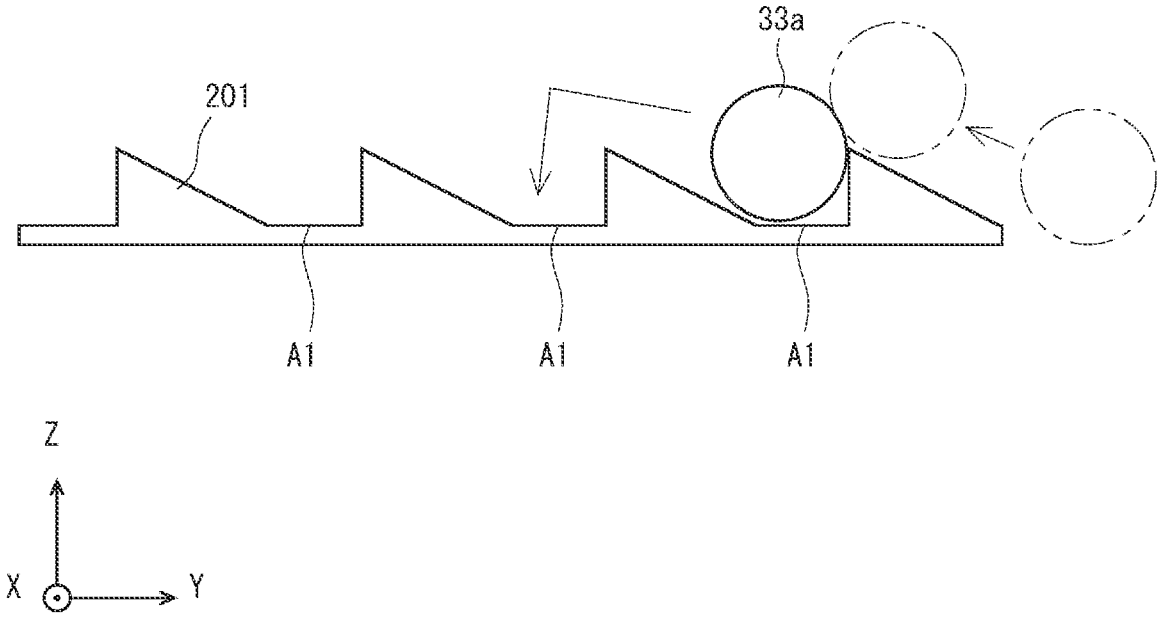
FIG. 18 is a side view showing a specific configuration of a restriction mechanism according to another embodiment.
Figure 19:
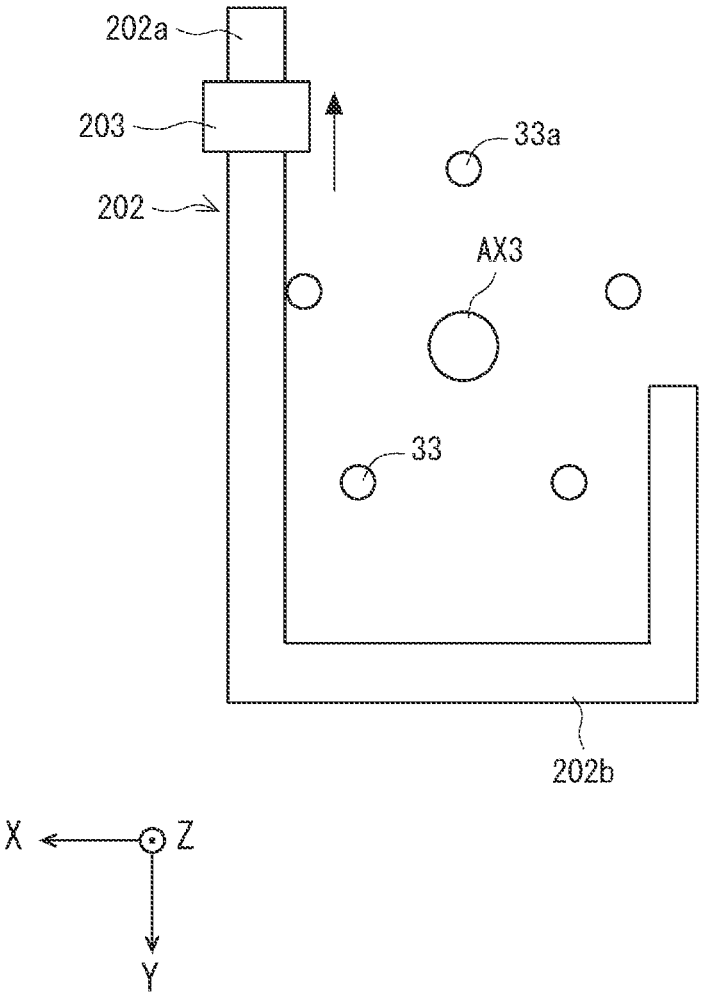
FIG. 19 is a plan view showing a state of a caster before constraint in the restriction mechanism according to the other embodiment.
Figure 20:
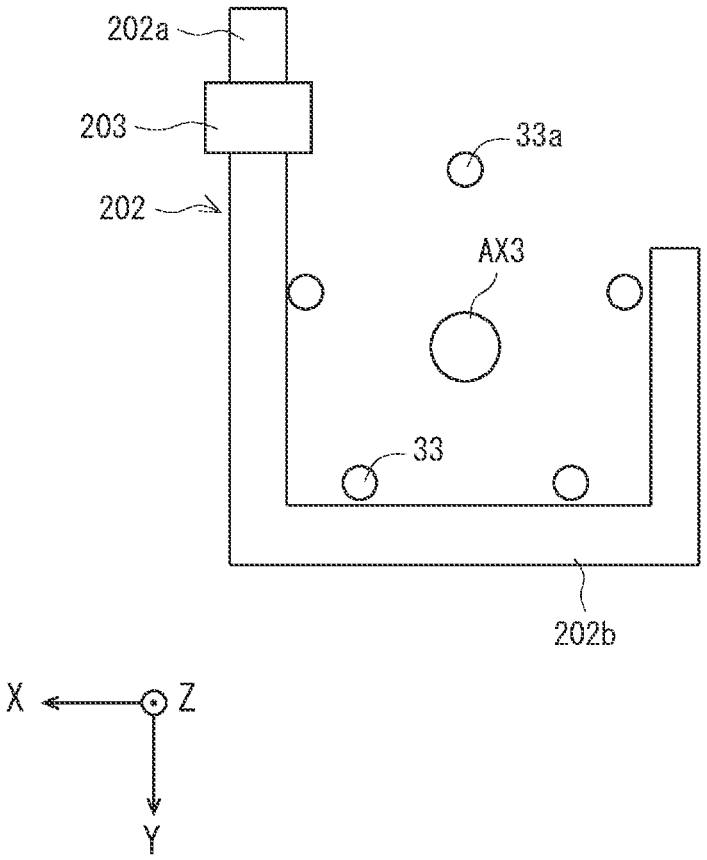
FIG. 20 is a plan view showing a state of the caster after constraint in the restriction mechanism according to the other embodiment.
Figure 21:
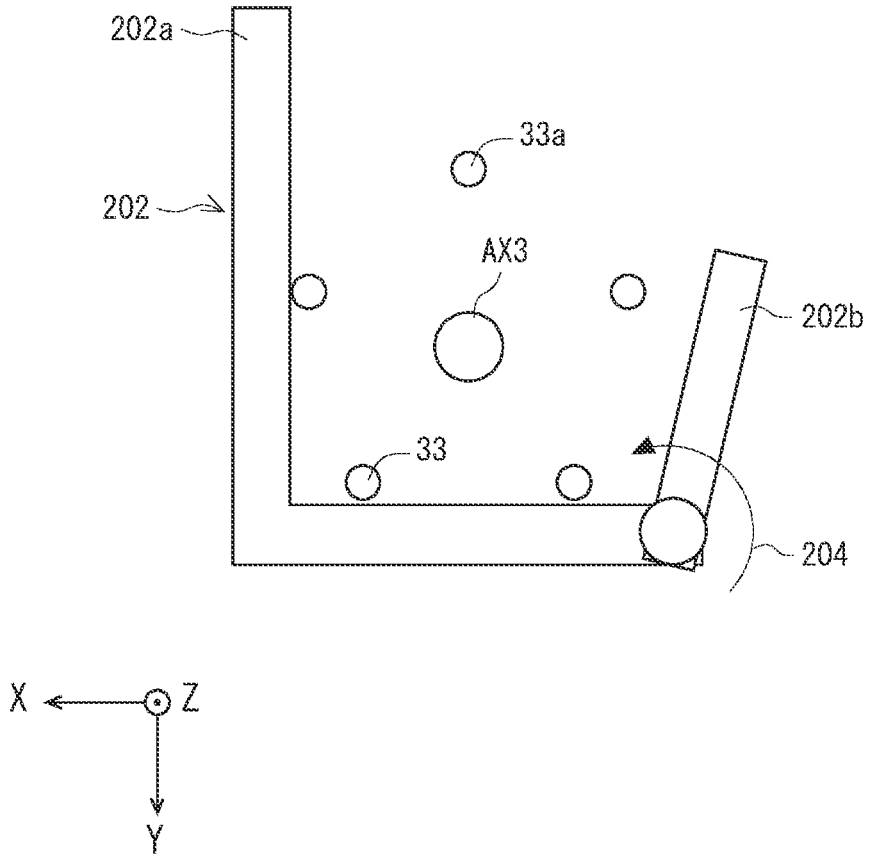
FIG. 21 is a plan view showing a state of the caster before constraint in the restriction mechanism according to the other embodiment.
Figure 22:
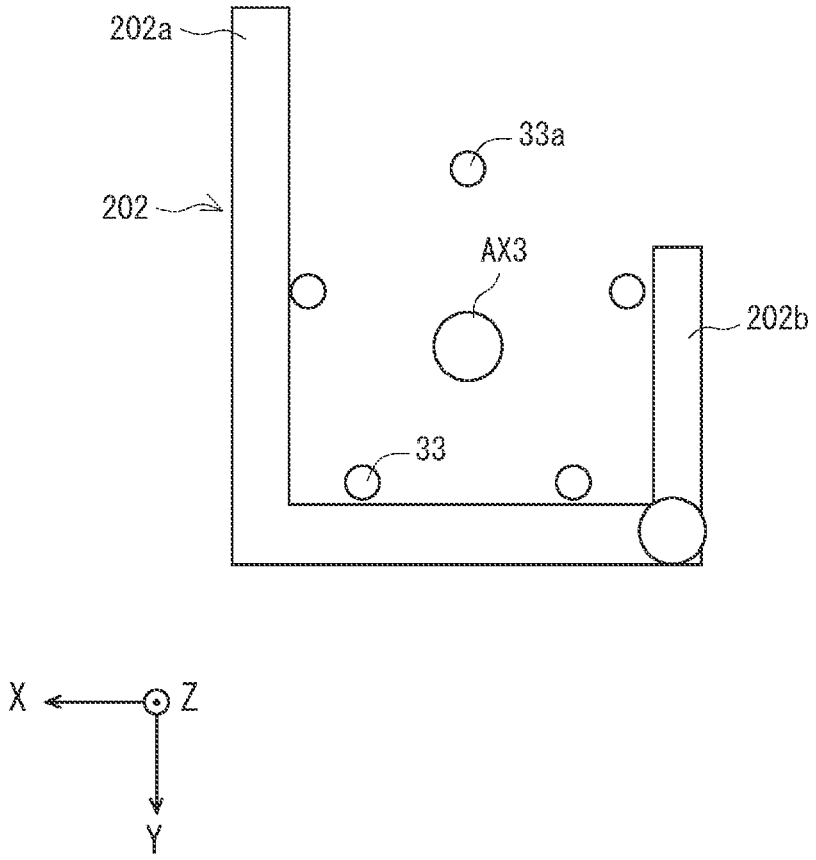
FIG. 22 is a plan view showing a state of the caster after constraint in the restriction mechanism according to the other embodiment.

For example, as shown in FIG. 18, a plurality of protruding contact parts 201 may be arranged in the Y-axis direction. In this way, the contact parts 201 can be selected appropriately according to the length of the user U's leg. That is, the reference arrangement range A1 of the caster 33*a* of the chair 3 can be changed appropriately according to the user U. It is also possible to arrange a plurality of the contact parts according to the first to tenth embodiment in the Y-axis direction and to make it possible to adjust the reference arrangement range A1 of the caster 33*a* in the Y-axis direction.

The lower limb exercise device according to the above embodiment may include a moving mechanism to move the contact part in the Y-axis direction of the exercise equipment 2. Also in this case, the position of the contact part in the Y-axis direction can be adjusted appropriately according to the length of the user U's leg. In some embodiments, in this case, the moving mechanism is configured in such a way that the contact part or the like can be moved in the Y-axis direction of the exercise equipment 2, for example, the contact part or the like can be moved by driving the moving mechanism with a motor or operating a lever.

In some embodiments, the moving mechanism is configured so that the relative position between the exercise equipment 2 and the contact part can be adjusted, for example, by coupling the exercise equipment 2 to the contact part with a linear guide including a lock mechanism that can change the relative position between the exercise equipment 2 and the contact part. Thus, the position of the reference arrangement range A1 of the caster 33*a* can be adjusted in the Y-axis direction.

For example, as shown in FIGS. 19 to 22, the restriction mechanism may be composed of a constraint mechanism for constraining the chair 3 by driving one end 202*b* of a constraint part 202 by a motor (e.g., elastic part 203), a lever operation 204, or the like, while the other end 202*a* of the constraint part 202 is fixed in the region of the reference arrangement range A1 on the Y-axis negative side, and pulling (stretching) the plurality of the casters 33 of the chair 3 from the Y-axis positive side to the Y-axis negative side, or winding (rotating) so as to wrap the casters 33, and fixing the one end 202*b* of the constraint part 202. In this case, the constraint part 202 may not constrain the plurality of casters 33 of the chair 3, and instead may constrain only the caster 33*a*. Thus, the position of the reference arrangement range A1 of the caster 33*a* can be adjusted in the Y-axis direction.

In short, the restriction mechanism may be configured to restrict the movement of the caster 33*a* of the chair 3 from the reference arrangement range A1 to at least the Y-axis positive side. Therefore, the contact part may be, for example, a plate member arranged near the end of the reference arrangement range A1 of the caster 33*a* of the chair 3 on the Y-axis positive side or may be a plurality of pin members arranged in the X-axis direction.

In some embodiments, the restriction mechanism has a configuration in which the restriction of movement of the caster 33*a* of the chair 3 to the Y-axis negative side becomes less than the restriction of movement thereof to the Y-axis positive side. With such a configuration, once the caster 33*a* is moved to the Y-axis negative side after the lower limb exercise is finished, and then the chair 3 is moved to the Y-axis positive side so as to avoid the restriction mechanism, the exercise equipment 2 and the chair 3 can be easily separated.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A lower limb exercise device for enabling a user to perform a lower limb exercise while the user is seated on a chair, the lower limb exercise device comprising:

exercise equipment for the user to perform the lower limb exercise; and a restriction mechanism configured to restrict movement of at least one caster of the chair from a reference arrangement range of the caster during the lower limb exercise, wherein the restriction mechanism includes a contact part where the caster that moves away from the exercise equipment is brought into contact, wherein a position of the contact part relative to the exercise device is constrained in a region on a side moving away from the exercise equipment in a front-rear direction of the lower limb exercise device, wherein an upper end of the contact part is arranged higher than a center of the caster with the caster arranged inside the reference arrangement range and the contact part arranged at an uppermost position, and wherein the contact part is a movable plate that can move in an up-down direction of the lower limb exercise device and is energized upward of the lower limb exercise device.

2. The lower limb exercise device according to claim 1, wherein an upper part of the restriction mechanism is open.

3. The lower limb exercise device according to claim 1, wherein the restriction mechanism is capable of adjusting a position of the reference arrangement range of the caster in the front-rear direction.

4. The lower limb exercise device according to claim 3, wherein the position of the reference arrangement range of the caster is made adjustable in the front-rear direction by providing a plurality of the restriction mechanisms in the front-rear direction of the lower limb exercise device.

5. The lower limb exercise device according to claim 3, wherein the position of the reference arrangement range of the caster is made adjustable in the front-rear direction by moving the restriction mechanism in the front-rear direction of the lower limb exercise device.

6. The lower limb exercise device according to claim 1, wherein a plurality of the contact parts are arranged in the front-rear direction of the lower limb exercise device.

7. The lower limb exercise device according to claim 1, wherein the restriction mechanism is detachable from the exercise equipment.

8. A lower limb exercise system comprising:

the lower limb exercise device according to claim 1; and the chair.

9. The lower limb exercise system according to claim 8, wherein the exercise equipment comprises:

a pair of left and right pedals on which the user's feet are placed; and a rotation mechanism configured to rotate the pedals by the user's feet pushing down the pedals.

10. A lower limb exercise device for enabling a user to perform a lower limb exercise while the user is seated on a chair, the lower limb exercise device comprising:

exercise equipment for the user to perform the lower limb exercise; and a restriction mechanism configured to restrict movement of at least one caster of the chair from a reference arrangement range of the caster during the lower limb exercise, wherein the restriction mechanism includes a grounding part of the caster, a position of the grounding part relative to the exercise equipment is constrained in a region on a side moving away from the exercise equipment in a front-rear direction of the lower limb exercise equipment, and a frictional force on the side moving away from the exercise equipment is greater than a frictional force on the side of the exercise equipment, wherein the grounding part includes a projection that is inclined upward of the lower limb exercise device toward the exercise equipment, and wherein the projection is made of an elastic body and a plurality of the projections are arranged in the front-rear direction of the lower limb exercise device.

* * * * *